US005747226A

United States Patent [19]

Nakamura et al.

[11] Patent Number: 5,747,226

[45] Date of Patent: May 5, 1998

[54] PROCESSING MATERIAL AND HEAT-DEVELOPED IMAGE FORMATION METHOD USING THE SAME

[75] Inventors: Yoshisada Nakamura; Shun-ichi Ishikawa; Kazuhiko Matsumoto, all of Kanagawa, Japan

[73] Assignee: Fuji Photo Film Co., Ltd., Kanagawa, Japan

[21] Appl. No.: 703,743

[22] Filed: Aug. 27, 1996

[30] Foreign Application Priority Data

Aug. 28, 1995 [JP] Japan ..... 7-240445

[51] Int. Cl.[6] ..... G03C 11/12

[52] U.S. Cl. ..... 430/348; 430/203; 430/206; 430/349; 430/350; 430/404

[58] Field of Search ..... 430/203, 206, 430/404, 348, 349, 350

[56] References Cited

U.S. PATENT DOCUMENTS

| | | | |
|---|---|---|---|
| 3,282,695 | 11/1966 | Narodny | 430/404 |
| 3,416,921 | 12/1968 | Coenen | 430/404 |
| 4,399,212 | 8/1983 | Boie et al. | 430/404 |
| 4,483,914 | 11/1984 | Naito et al. | 430/203 |
| 4,590,154 | 5/1986 | Hirai et al. | 430/203 |
| 4,740,445 | 4/1988 | Hirai et al. | 430/203 |
| 4,745,043 | 5/1988 | Hirai | 430/203 |
| 4,782,004 | 11/1988 | Takeuchi et al. | 430/203 |
| 4,784,931 | 11/1988 | Aotsuka et al. | 430/203 |
| 5,066,563 | 11/1991 | Aono et al. | 430/203 |
| 5,164,280 | 11/1992 | Texter et al. | 430/404 |
| 5,200,295 | 4/1993 | Vermeulen et al. | 430/404 |
| 5,334,482 | 8/1994 | Aono | 430/203 |
| 5,429,907 | 7/1995 | Uytterhoeven et al. | 430/348 |
| 5,478,693 | 12/1995 | Hirai | 430/203 |
| 5,480,761 | 1/1996 | Bailey et al. | 430/203 |

*Primary Examiner*—Hoa Van Le

*Attorney, Agent, or Firm*—Sughrue, Mion, Zinn, Macpeak & Seas, PLLC

[57] ABSTRACT

Provided are a processing material used for forming images on a heat-developable photosensitive material by heating the processing material and the photosensitive material in a condition that they are brought into face-to-face contact, with the processing material comprising a long web support, preferably having a thickness of from 4 to 40 μm, provided thereon a processing layer, preferably comprising a base or a precursor of bases; and a method of forming images on a heat-developable photosensitive material, which comprises a step of supplying a fountain water to the photosensitive material, a step of bringing the dampened photosensitive material into face-to-face contact with the aforesaid processing material and a step of applying heat thereto.

3 Claims, No Drawings

PROCESSING MATERIAL AND HEAT-DEVELOPED IMAGE FORMATION METHOD USING THE SAME

FIELD OF THE INVENTION

The present invention relates to a processing material and a method of forming a heat-developed image by the use of a processing material. In particular, the invention is concerned with a processing material improved in handling characteristics.

BACKGROUND OF THE INVENTION

Heat-developable photosensitive materials comprising silver halide are known, and the materials themselves and methods of processing them are described, e.g., in *Shashin Kogaku no Kiso, Higin-en Shashin Hen* (which means "The Fundamentals of Photographic Engineering, The Volume of Non-Silver Photography"), pages 242–255, Corona Publishing Co. Ltd. (1982), and U.S. Pat. No. 4,500,626.

In addition thereto, methods of forming dye images by coupling reaction of an oxidized developing agent with couplers are described, e.g., in U.S. Pat. Nos. 3,761,270 and 4,021,240, and methods of forming positive dye images by sensitized silver dye bleach process are described, e.g., in U.S. Pat. No. 4,235,957.

Recently, there has been proposed the method in which diffusible dyes are released or formed in an imagewise pattern by heat development and then transferred into a dye-fixing element. Such a method can provide both negative and positive dye images if the kind of dye-providing compounds used therein or the type of silver halide used therein is chosen properly. Details of that method are described in U.S. Pat. Nos. 4,500,626, 4,483,914, 4,503,137 and 4,559,290, JP-A-58-149046, JP-A-60-133449, JP-A-59-218443, JP-A-61-238056 (The term "JP-A" as used herein means an "unexamined published Japanese patent application"), EP-A-0220746, Kokai Giho 87-6199, EP-A2-0210660 and so on.

As for the formation of positive color images by means of heat development, many other methods have been proposed. For instance, U.S. Pat. No. 4,559,290 proposes the method in which the compound obtained by converting the so-called DDR compound into the oxidized form thereof, therefore which has lost a dye-releasing capacity, is made to be present together with a reducing agent or a precursor thereof, the reducing agent is oxidized in proportion to the amount of exposure provided for silver halide through heat development, and the aforesaid compound is reduced by the reducing agent remaining unoxidized to release a diffusible dye. Further, in EP-A-0220746 and Kokai Giho 87-6199 (Vol. 12, No. 22), are described the heat-developable color photosensitive materials in which the compounds capable of releasing diffusible dyes by the reductive cleavage of a N—X bond (wherein X represents an oxygen, sulfur or nitrogen atom) are used as the compounds capable of releasing diffusible dyes by the same mechanism as described above.

The heat-development processing in the above-cited methods is carried out by bringing a photosensitive material into face-to-face contact with an image-receiving sheet and then heating them, thereby transferring a diffusible dye from the photosensitive material to the image-receiving sheet to form a dye image in the image-receiving sheet. In this case, the relative images are formed in the image-receiving sheet as well as in the photosensitive material. In cases where the image on the photosensitive material side is utilized, the image-receiving sheet can be regarded as a processing material. It is desirable for this processing material to have excellent handling characteristics.

SUMMARY OF THE INVENTION

Therefore, an object of the present invention is to make improvements in handling characteristics of a processing material used in a system of the kind which utilizes images formed in a photosensitive material by the combined use of the photosensitive material and the processing material.

The aforesaid object is attained by a processing material which is used for forming images on a heat-developable photosensitive material by heating the processing material and the photosensitive material in a condition that they are brought into face-to-face contact, the processing material comprising a long web support provided thereon a processing layer; and a method of forming images on a heat-developable photosensitive material, the method comprising the steps of providing a fountain water for the photosensitive material and heating the photosensitive material in a condition that it is brought into face-to-face contact with a processing material comprising a long web support provided thereon a processing layer.

DETAILED DESCRIPTION OF THE INVENTION

The term "a long web support", which constitutes the present processing material, refers to the support which has a length longer by far than the length of a photosensitive material faced therewith at the time of processing and, in performing the processing, is used without cutting off a part thereof to enable continuous processing of a plurality of photosensitive materials. Specifically, the processing material has a length greater than a width thereof by a factor of from 5 to 1,000. As for the width of the processing material, the processing material may have any width, but it is desirable that the width thereof be greater than the width of a photosensitive material to be faced therewith at the time of processing.

Also, it is desirable for the processing to be carried out in a form such that a plurality of photosensitive materials are arranged in rows on the processing material. In this case, it is desirable that the width of the processing material be greater than the value obtained by multiplying the width of a photosensitive material, by the number of photosensitive materials processed simultaneously.

Such a processing material having the form of a long web without breaks (which is called a long-web processing material for short, hereinafter) is particularly advantageous to cases where a photosensitive material to be processed has a length of no shorter than 50 cm and a plurality of photosensitive materials are to be processed continuously.

In a case where the processing material described above is used, it becomes easy to release photosensitive materials from the processing material after development.

The present long-web processing material is desirably fed from a supply roll and wound onto a take-up roll, followed by disposal thereof. The disposal is particularly easy when large-sized photosensitive materials are used.

As mentioned above, the present long-web processing material is considerably improved in handling characteristics, compared with conventional sheet-form processing materials.

The thickness of a support used for the present processing material can be arbitrarily chosen, but a thin support is preferable. In particular, the support having a thickness in the range of 4 μm to 40 μm is used to advantage. In case of a thin support, the quantity of processing materials per unit volume is large, so that the foregoing rolls used for a processing material can be made compact.

The present processing material has no particular restriction as to a support material as far as the material can withstand processing temperatures. In general, photographic supports, including various types of paper and synthetic polymer films, as described in *Shashin Kogaku no Kiso—Gin-en Shashin Hen* (which means "Fundamentals of Photographic Engineering—The Volume of Silver Salt Photography"), pages 223–240, compiled by The Society of Photographic Science and Technology of Japan, published by Corona Publishing Co., Ltd. in 1979, can be used. Specific examples of such photographic supports include films of polyethylene terephthalate, polyethylene naphthalate, polycarbonate, polyvinyl chloride, polystyrene, polypropylene, polyimide and celluloses (e.g., triacetyl cellulose); the above-recited films to which pigments, such as titanium oxide, are added; synthetic paper made from polypropylene or the like; paper made from mixed pulp, e.g., a mixture of synthetic resin pulp, such as polyethylene pulp, with natural wood pulp; Yankee paper; baryta paper; coated paper (especially, cast coat paper); and so on.

These types of paper and films can be used alone, or a paper or film laminated with a synthetic polymer, such as polyethylene on one side or both sides can be used as a support.

Other supports which can be employed are those described, e.g., in JP-A-62-253159 (pages 29–31), JP-A-1-161236 (pages 14–17), JP-A-63-316848, JP-A-2-22651, JP-A-3-56955, and U.S. Pat. No. 5,001,033.

In addition, the support constituted mainly of a syndiotactic styrene polymer can also be used to advantage.

To the surface of a support as recited above, a hydrophilic binder, alumina sol, a semiconductive metal oxide, such as tin oxide, and an antistatic agent, such as carbon black, may be applied.

The present processing material is used not only for the purpose of transferring diffusible dyes thereto, as described hereinbefore, but also with the intentions of the interception of air upon development by heating, the prevention of vaporization of ingredients from the photosensitive material, the supply of ingredients used for processing to the photosensitive material, and the removal of ingredients which are incorporated in the photosensitive material but become unnecessary after development, and unnecessary components produced by development.

In the present invention, it is desirable to use a base or its precursor for the purpose of promoting the image formation. From the viewpoint of keeping quality, it is desirable for them to be incorporated in a processing layer of the processing material. Additionally, when a base is produced by the reaction of two or more substances, a state such that one substance alone is incorporated in the processing layer is within the scope of the present invention.

As for the base and precursors thereof, compounds known to be used at the time of development-processing of heat-developable photosensitive materials can be examples thereof.

With respect to the precursors of bases, there are known the salts formed by bases and organic acids capable of undergoing decarboxylation upon heating, and the compounds capable of releasing amines by intramolecular nucleophilic substitution reaction, Lossen rearrangement or Beckmann rearrangement. Specific examples of such a precursor of bases are described in U.S. Pat. Nos. 4,514,493 and 4,657,848, and *Kochi Gijutsu* No. 5, pp. 55–86 (published in Mar. 22, 1991, by Azutec Company Inc.). When the combination of a basic metal compound sparingly soluble in water with the so-called complexing compound, or a compound capable of complexing the metal ion which constitutes the basic metal compound, as described in EP-A-0210660 and U.S. Pat. No. 4,740,445, is utilized as a precursor of bases, it is desirable that the basic metal compound sparingly soluble in water (e.g., zinc hydroxide) be incorporated in a photosensitive material and the complexing compound (e.g., guanidine picolinate) be added to a processing layer of the processing material.

The amount of a base or its precursor used is from 0.1 to 20 g/m$^2$, preferably from 1 to 10 g/m$^2$.

It is desirable in the present invention that, after supplying a fountain water to a heat-developable photosensitive material, the photosensitive material be brought into face-to-face contact with the processing material having a processing layer provided on a long web and subjected to heat development. This embodiment is effective in particular for the case of using as a precursor of bases the foregoing combination of a basic metal compound sparingly soluble in water with a complexing compound.

As for the binder used in the processing layer, hydrophilic binders are preferred. As examples of such a binder, mention may be made of those described in *Research Disclosure*, Nos. 17643, 18716 and 307105, and those described at pages 71–75 of JP-A-64-13546. Specifically, transparent or translucent hydrophilic binders are desirable, and examples thereof include natural compounds, e.g., proteins, such as gelatin and gelatin derivatives, and polysaccharides, such as cellulose derivatives, starch, gum arabic, dextran and pullulan, as well as synthetic high molecular compounds, such as polyvinyl alcohol, polyvinyl pyrrolidone and acrylamide polymers. Further, it is possible to use as the binder the highly water-absorbing polymers described, e.g., in U.S. Pat. No. 4,960,681 and JP-A-62-245260. More specifically, those polymers are homo- or copolymers of vinyl monomers having —COOM or —$SO_3M$ (wherein M is a hydrogen atom or an alkali metal), such as sodium methacrylate and ammonium methacrylate, and copolymers of a vinyl monomer having the foregoing group and other vinyl monomers (e.g., Sumikagel L- 5H, trade name, a product of Sumitomo Chemical Co., Ltd.). The binders recited above can be used as combination of two or more thereof. In particular, it is desirable to combine gelatin with some of the foregoing binders. As for the gelatin, lime-processed gelatin, acid-processed gelatin or delimed gelatin having reduced contents of calcium and the like may be properly chosen depending on the intended purpose. Also, it is desirable that those gelatins be used in combination.

An appropriate binder coverage in the present invention is 20 g/m$^2$ or less, particularly 10 g/m$^2$ or less.

Further, the presence of a protective layer in the processing material is useful.

Examples of a silver halide-containing heat-developable photosensitive material which can be appropriately used in the present invention include the photosensitive material as described in Japanese Patent Application No. 7-45018, wherein a black and white silver image is formed; those mentioned above as known examples, which produce color images by coupling reaction; and those releasing diffusible dyes in an imagewise pattern.

In the formation of black and white silver images, it is desirable that silver halide having a chloride content of at least 80 mole % be used, and further physical development specks and a silver halide solvent be incorporated in the processing layer.

Soluble silver salts diffused from a photosensitive material are reduced by physical development specks; as a result, they are converted to physically developed silver and fixed to the processing layer. Therein can be employed all of known physical development specks, such as heavy metals including zinc, mercury, lead, cadmium, iron, chromium, nickel, tin, cobalt, copper, ruthenium and the like, precious metals including palladium, platinum, silver, gold and the like, and colloidal particles of chalcogen compounds including sulfur, selenium and tellurium compounds of metals as recited above. A substance to constitute those physical development specks can be obtained by reducing metal ions as recited above with a reducing agent, such as ascorbic acid, sodium borohydrate or hydroquinone, to prepare a metal colloid dispersion, or by mixing metal ions as recited above with a solution of soluble sulfide, selenide or telluride to prepare a colloidal dispersion of water-insoluble metal sulfide, metal selenide or telluride. Such a dispersion is preferably formed in a hydrophilic binder, such as gelatin. Preparation methods of colloidal silver particles are described, e.g., in U.S. Pat. No. 2,688,601. For the removal of excess salts, the foregoing dispersions may receive desalting treatments known in conventional preparation methods of silver halide emulsions, if needed.

As for the size of those physical development specks, particles measuring 2 to 200 nm in diameter are preferable.

Those physical development specks are usually incorporated in a processing layer at a coverage rate of from $10^{-3}$ to 100 mg/m$^2$, preferably from $10^{-2}$ to 10 mg/m$^2$.

The physical development specks may be formed in a coating solution containing a hydrophilic binder by reacting, e.g., silver nitrate with sodium sulfide, or gold chloride with a reducing agent, although a coating solution can be admixed with physical development specks prepared separately.

Examples of physical development specks which can be used to advantage include silver, silver sulfide and palladium sulfide. In a case of using as an image the silver developed physically through the transfer to a complexing agent sheet, palladium sulfide, silver sulfide and the like are preferably used as physical development specks from the viewpoint of lower Dmin and higher Dmax.

As for the silver halide solvent incorporated in the processing layer, any of known silver halide solvents can be used. Specific examples of such a silver halide solvent include thiosulfates, such as sodium thiosulfate and ammonium thiosulfate; sulfites, such as sodium sulfite and sodium hydrogen sulfite; thiocyanates, such as potassium thiocyanate and ammonium thiocyanate; the thioether compounds described in JP-B-47-11386 (The term "JP-B" as used herein means an "examined Japanese patent publication"), such as 1,8-di-3,6-dithiaoctane, 2,2'-thiodiethanol and 6,9-dioxa-3,12-dithiatetradecane-1,14-diol; the 5- or 6-membered imide ring-containing compounds described in JP-A-8-179458, such as uracil and hydantoin; and the compounds of the following formula (I) described in JP-A-53-144319:

$$N(R^1)(R^2)—C(=S)—X—R^3 \quad (I)$$

wherein X represents a sulfur atom or an oxygen atom; $R^1$ and $R^2$ are identical or different, and each represents an aliphatic group, an aryl group, a heterocyclic group or an amino group; and $R^3$ represents an aliphatic group or an aryl group; or the combination of $R^1$ with $R^2$, or $R^2$ with $R^3$ forms a 5- or 6-membered hetero ring.

In addition, the trimethyltriazolium thiolate and meso ion thiolate compounds described in *Analytica Chemica Acta*, vol. 248, pages 604–614 (1991) are preferably used as well. Further, the compounds described in JP-A-8-69097, which can stabilize silver halide by fixation, can also be used as silver halide solvent. The silver halide solvents recited above can be used as a mixture of two or more thereof.

Of the above-recited compounds, sulfites and 5- or 6-membered imide ring-containing compounds, such as uracil and hydantoin, are particularly preferred over the others. In particular, the addition of uracil or hydantoin in the form of potassium salt has an advantage in making it possible to mitigate a drop in surface gloss of the processing material upon storage.

The content of total silver halide solvents in the processing layer is from 0.01 to 50 mmol/m$^2$, preferably from 0.1 to 30 mmol/m$^2$, and more preferably from 1 to 20 mmol/m$^2$. The ratio of the coverage of the total silver halide solvents to the silver coverage of a photosensitive material is from 1:20 to 20:1, preferably from 1:10 to 10:1, and more preferably from 1:3 to 3:1, by mole. Silver halide solvents may be added to a coating solution in the form of solution in water, methanol, ethanol, acetone, dimethylformamide, methyl propyl glycol or the like, or in the form of alkaline or acidic aqueous solution, or may be dispersed into a coating solution in the form of solid fine particles.

Further, the polymers described in JP-A-8-179458, which comprise vinyl imidazole and/or vinyl pyrrolidone as constitutional repeating units, can be incorporated in the processing layer to heighten the density of silver image in a photosensitive material.

Heat-developable photosensitive materials used mainly for the formation of color images, particularly for photographing use, are described below in detail.

Silver halides usable in the present invention may be any of silver chloride, silver bromide, silver iodobromide, silver chlorobromide, silver chloroiodide and silver chloroiodobromide.

Silver halide emulsions used in the present invention may be those of surface latent image type in which a latent image is formed predominantly at the surface of the grains, or those of internal latent image type in which a latent image is formed mainly in the interior of the grains. The emulsions of the internal latent image type are combined with a nucleating agent or fogging with light, and thereby they are used as direct reversal emulsions. Also, they may be the so-called core/shell emulsions comprising grains which differ in phase between the inner part and the surface layer thereof. Further, silver halide phases different in composition may be fused together by forming an epitaxial junction. The silver halide emulsions used may have either monodisperse or polydisperse distribution with respect to grain size. However, as described in JP-A-1-167743 and JP-A-4-223463, it is desirable to adopt the method of mixing monodisperse emulsions to control the gradation. It is desirable for the grain size to be from 0.1 to 2 μm, particularly from 0.2 to 1.5 μm. As for the crystal habit, silver halide grains may have any of a regular crystal form, such as that of a cube, an octahedron or a tetradecahedron, an irregular crystal form, such as that of a sphere or a tablet having a high aspect ratio, a crystal form having defects such as twinning plane(s), a composite form thereof and so on.

More specifically, the present invention can use any of silver halide emulsions prepared using various methods as described, e.g., in U.S. Pat. No. 4,500,626 (column 50), U.S. Pat. No. 4,628,021, *Research Disclosure* (abbreviated as "RD", hereinafter) No. 17029 (1978), RD No. 17643, pp.

22–23 (December, 1978), RD No. 18716, p. 648 (November, 1979), RD No. 307105, pp. 863–865 (November, 1989), JP-A-62-253159, JP-A-64-13546, JP-A-2-236546, JP-A-3-110555; and further, P. Grafkides, *Chemie et Phisique Photographique*, Paul Montel, Paris (1967); G. F. Duffin, *Photographic Emulsion Chemistry*, The Focal Press, London (1966); V. L. Zelikman et al., *Making and Coating Photographic Emulsion*, The Focal Press, London (1964); and so on.

In a process of preparing light-sensitive silver halide emulsions, it is desirable to carry out the so-called desalting operation, that is, removal of excess salts from the silver halide emulsions. The removal can be effected using the noodle washing method which comprises gelling the gelatin, or using a flocculation method which takes advantage of a polyvalent anion-containing inorganic salt (such as sodium sulfate), an anionic surfactant, an anionic polymer (such as sodium polystyrenesulfonate), or a gelatin derivative (such as an aliphatic acylated gelatin, an aromatic acylated gelatin or an aromatic carbamoylated gelatin). Preferably, such a flocculation method is employed in the present invention.

To the light-sensitive silver halide emulsions used in the present invention, heavy metal ions such as iridium, rhodium, platinum, cadmium, zinc, thallium, lead, iron and osmium ions can be added for various purposes. Such metal ions may be used alone, or as combination of two or more thereof. The amount of heavy metal ions added, though it depends on their intended purpose, is generally of the order of $10^{-9}$–$10^{-3}$ mole per mole of silver halide. Those metal ions may be introduced into emulsion grains so that the distribution thereof is uniform throughout the grains or localized in the inner or surface part of the grains. Specifically, the emulsions described, e.g., in JP-A-2-236542, JP-A-1-116637 and JP-A-5-181246 are used to advantage.

In the step for the formation of silver halide grains for light-sensitive silver halide emulsions, a thiocyanate, ammonia, a tetra-substituted thiourea compound, the organic thioether compounds described in JP-B-47-11386, sulfur-containing compounds described in JP-A-53-144319 and the like can be used as silver halide solvent.

For details of other conditions under which silver halide emulsions used in the present invention can be prepared, descriptions in the above-cited books, namely P. Grafkides, *Chemie et Phisique Photographique*, Paul Montel, Paris (1967); G. F. Duffin, *Photographic Emulsion Chemistry*, The Focal Press, London (1966); and V. L. Zelikman et al., *Making and Coating Photographic Emulsion*, The Focal Press, London (1964); can be referred to. Specifically, the silver halide emulsions can be prepared by any of an acid process, a neutral process and an ammonia process. Further, a method suitably employed for reacting a water-soluble silver salt with a water-soluble halide can be any of a single jet method, a double jet method and a combination thereof. In order to obtain a monodisperse emulsion, a double jet method is preferably adopted.

Also, a reverse mixing method in which silver halide grains are produced in the presence of excess silver ion can be employed. In addition, the so-called controlled double jet method, in which the pAg of the liquid phase in which silver halide grains are to be precipitated is maintained constant, can also be used.

Moreover, for the purpose of increasing the speed of grain growth, the concentrations, the amounts and the speeds in adding a silver salt and a halogen salt respectively can be increased (as described in JP-A-55-142329, JP-A-55-158124 and U.S. Pat. No. 3,650,757).

Further, the agitation of a reaction solution may be carried out by any of known methods. Furthermore, the temperature and the pH of a reaction solution during the formation of silver halide grains can be chosen properly depending on the intended purpose. An appropriate pH range is from 2.2 to 7.0, especially from 2.5 to 6.0.

Light-sensitive silver halide emulsions are, in general, chemically sensitized silver halide emulsions. In chemically sensitizing silver halide emulsions used in the present invention, known chemical sensitization processes for emulsions of general photosensitive materials, such as a chalcogen sensitization process, including a sulfur sensitization process, a selenium sensitization process and a tellurium sensitization process, a precious metal sensitization process using gold, platinum, palladium or the like, and a reduction sensitization process, can be employed alone or in combination of two or more thereof (as described, e.g., in JP-A-3-110555 and JP-A-5-241267). Such chemical sensitization can be also carried out in the presence of a nitrogen-containing heterocyclic compound (as described in JP-A-62-253159). Further, an antifoggant recited hereinafter can be added after the conclusion of chemical sensitization. The addition of an antifoggant can be performed in the ways as described in JP-A-5-45833 and JP-A-62-40446.

The pH during the chemical sensitization is preferably from 5.3 to 10.5, and more preferably from 5.5 to 8.5; while the pAg is preferably from 6.0 to 10.5, and more preferably from 6.8 to 9.0.

The coverage rate of light-sensitive silver halide emulsions used in the present invention is from 1 mg/m$^2$ to 10 g/m$^2$ on a silver basis.

In order to confer color sensitivities, including green sensitivity, red sensitivity and infrared sensitivity, upon light-sensitive silver halide used in the present invention, light-sensitive silver halide emulsions are spectrally sensitized with methine dyes or other dyes. Further, a light-sensitive silver halide emulsion may be spectrally sensitized in a blue region to be rendered blue-sensitive, if needed.

Suitable dyes which can be used for the foregoing purpose include cyanine dyes, merocyanine dyes, complex cyanine dyes, complex merocyanine dyes, holopolar cyanine dyes, hemicyanine dyes, stylyl dyes and hemioxonol dyes.

Specific examples of such sensitizing dyes are recited in U.S. Pat. No. 4,617,257, JP-A-59-180550, JP-A-64-13546, JP-A-5-45828, JP-A-5-45834, and so on.

These sensitizing dyes may be employed individually or in combination. In particular, combinations of sensitizing dyes are often used for the purpose of supersensitization and adjustment to the intended spectral sensitization wavelengths.

Dyes which themselves do not spectrally sensitize silver halide emulsions, or compounds which do not substantially absorb light in the visible region, but which each can exhibit a supersensitizing effect in combination with a certain sensitizing dye, may be incorporated into silver halide emulsions (as described, e.g., in U.S. Pat. No. 3,615,641 and JP-A-63-23145).

These sensitizing dyes may be added to silver halide emulsions during, before or after the chemical ripening, or before or after the nucleation of silver halide grains according to the embodiments of U.S. Pat. Nos. 4,183,756 and 4,225,666. Additionally, those sensitizing dyes and supersensitizing materials may be added in the form of solution dissolved in an organic solvent, such as methanol, or in the form of dispersion in gelatin, or in the form of solution comprising a surfactant. A suitable amount of each of such ingredients added is generally of the order of from $10^{-8}$ to $10^{-2}$ mole per mole of silver halide.

The other additives used during the aforementioned steps and known photographic additives which can be used in the present invention are described in the above-cited RD No. 17643, RD No. 18716 and RD No. 307105. The following is a list of those additives and the locations of their descriptions in the above-cited references.

| | Additives | RD 17643 | RD 18716 | RD 307105 |
|---|---|---|---|---|
| 1. | Chemical Sensitizer | p. 23 | p. 648, right column | p. 866 |
| 2. | Sensitivity Rising Agent | | p. 648, right column | |
| 3. | Spectral Sensitizer, and Supersensitizing Agent | pp. 23–24 | p. 648, right column, to p. 649, right column | pp. 866–868 |
| 4. | Brightening Agent | p. 24 | p. 648, right column | p. 868 |
| 5. | Antifoggant and Stabilizer | pp. 24–25 | p. 649, right column | pp. 868–870 |
| 6. | Light Absorbent, Filter Dye, and UV Absorbent | pp. 25–26 | p. 649, right column, to p. 650, left column | p. 873 |
| 7. | Dye Image Stabilizer | p. 25 | p. 650, left column | p. 872 |
| 8. | Hardener | p. 26 | p. 651, left column | pp. 874–875 |
| 9. | Binder | p. 26 | p. 651, left column | pp. 873–874 |
| 10. | Plasticizer, and Lubricant | p. 27 | p. 650, right column | p. 876 |
| 11. | Coating Aid, and Surfactant | pp. 26–27 | p. 650, right column | pp. 875–876 |
| 12. | Antistatic Agent | p. 27 | p. 650, right column | pp. 876–877 |
| 13. | Matting Agent | | | pp. 878–879 |

In the present invention, organometal salts can be used as oxidizer together with light-sensitive silver halide. Of organometal salts, organosilver salts are preferred in particular.

As for the organic compounds usable for forming organosilver salt oxidizers, the compounds described in U.S. Pat. No. 4,500,626 (columns 52–53), including benzotriazoles and fatty acids, are examples thereof. In addition, the acetylene compounds described in U.S. Pat. No. 4,775,613 are also useful. Organosilver salts may be used as a mixture of two or more thereof.

Those organosilver salts can be used in an amount of from 0.01 to 10 moles, preferably from 0.01 to 1 mole, per mole of light-sensitive silver halide. An appropriate total coverage of light-sensitive silver halide and organosilver salts is in the range of 0.05 to 10 g/m$^2$, preferably 0.1 to 4 g/m$^2$, based on silver.

As for the binder of the present photosensitive material, the same types of binders as used in the processing material can be employed in the same amount range as adopted therein.

In cases where it is intended to obtain developed color images by coupling reaction, couplers are incorporated in a photosensitive material used in the present invention.

The couplers employed in the present invention may be four-equivalent couplers or two-equivalent couplers. Their nondiffusible groups may have the form of a polymer chain. Specific examples of such couplers are described in detail in T. H. James, *The Theory of the Photographic Process*, 4th edition, pages 291–334 and 354–361, and JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474, JP-A-60-66249, JP-A-8-146578, JP-A-8-110608, JP-A-8-146552, and so on.

In addition, it is also desirable to use the couplers recited below.

As for the yellow couplers, suitable ones are the couplers represented by formulae (I) and (II) respectively in EP-A-0502424, the couplers represented by formulae (1) and (2) respectively in EP-A-0513496, the coupler represented by formula (I) in claim 1 of JP-A-5-307248, the coupler represented by formula D on column 1, lines 45–55, of U.S. Pat. No. 5,066,576, the coupler represented by formula D in paragraph [0008] of JP-A-4-274425, the coupler described in claim 1 (at page 40) of EP-A1-0498381, the coupler represented by formula (Y) at page 4 of EP-A1-0447969, and the couplers represented by formulae (I) to (IV) on column 7, lines 36–58, of U.S. Pat. No. 4,476,219.

As for the magenta couplers, suitable ones are the couplers described in JP-A-3-39737, JP-A-6-43611, JP-A-5-204106, and JP-A-4-3626.

As for the cyan couplers, suitable ones are the couplers described in JP-A-4-204843 and JP-A-4-43345.

As for the polymeric couplers, suitable ones are the couplers described in JP-A-2-44345.

As for the couplers which can provide colored dyes having moderate diffusibility, those described in U.S. Pat. No. 4,366,237, British Patent 2,125,570, European Patent No. 96570 and German Patent No. 3,234,533 are preferable.

Further, functional couplers as described below may be incorporated in a photosensitive material. Specifically, such couplers include the couplers capable of correcting unnecessary absorption of colored dyes. More specifically, the yellow colored cyan couplers described in EP-A1-0456257, the yellow colored magenta couplers described in EP, supra, the magenta colored cyan couplers described in U.S. Pat. No. 4,833,069, and the colorless masking couplers represented by (2) of U.S. Pat. No. 4,837,136 and Formula (A) in claim 1 of WO 92/11575 (especially, the exemplified compounds at pages 36–45) are representatives thereof.

As examples of compounds (including couplers) capable of releasing photographically useful compound residues by the reaction with the oxidation product of a developing agent, mention may be made of development inhibitor releasing compounds, the compounds represented by formulae (I) to (IV) in EP-A1-0378236 (page 11), the compound represented by formula (I) in EP-A2-0436938 (page 7), the compound represented by formula (1) in JP-A-5-307248, the compounds represented by formulae (I), (II) and (III) in EP-A2-0440195 (pages 5–6), the compound (ligand releasing compound) represented by formula (I) in claim 1 of JP-A-6-59411, and the compound represented by LIG-X in claim 1 of U.S. Pat. No. 4,555,478.

For the purpose of reducing a development time, making improvements in sensitivity, raising image densities and so on, it is desirable that a color developing agent which, when oxidized by silver development, can produce dyes by coupling with the above-recited couplers be incorporated in a photosensitive material used in the present invention.

In this case, the combination of a p-phenylenediamine developing agent with a phenol or active methylene coupler, as described in U.S. Pat. No. 3,531,256, and the combination of a p-aminophenol developing agent with an active methylene coupler, as described in U.S. Pat. No. 3,761,270, can be employed.

Further, the combinations of sulfonamidophenol with four-equivalent couplers as described in U.S. Pat. No. 4,021,240 and JP-A-60-128438 are used to advantage, because they can have excellent freshness-keeping properties when incorporated in a photosensitive material.

In incorporating a color developing agent into a photosensitive material, a precursor thereof may be used.

Examples of such a precursor include the indoaniline compounds described in U.S. Pat. No. 3,342,597, the Schiff base type compounds described in U.S. Pat. No. 3,342,599, RD Nos. 14850 and 15159, the aldol compounds described in RD No. 13924, the metal complexes described in U.S. Pat. No. 3,719,492, and the urethane compounds described in JP-A-53-135628.

Further, the combinations of couplers with the sulfonamidophenol developing agent described in Japanese Patent Application No. 7-180568, and the combinations of couplers with the hydrazine developing agent described in Japanese Patent Application Nos. 7-49287 and 7-63572 are preferably used in the present photosensitive material.

When a nondiffusible developing agent is used, an electron transmitting agent and/or a precursor thereof can be used in combination therewith, if needed, in order to promote the electron transfer between the nondiffusible developing agent and developable silver halide. In particular, electron transmitting agents described in U.S. Pat. No. 5,139,919 and EP-A-0418743 can be preferably employed. As for the method of introducing such an agent into a photosensitive material, it is desirable to adopt the methods described in JP-A-2-230143 and JP-A-2-235044, because they can ensure the stable introduction into layers.

The electron transmitting agent or a precursor thereof can be chosen from the aforementioned developing agents or precursors thereof. It is desirable for them that their mobilities be greater than that of a nondiffusible developing agent (electron donor). Especially useful electron transmitting agents are 1-phenyl-3-pyrazolidones and aminophenols.

Also, the precursors of electron donors, as described in JP-A-3-160443, can be employed to advantage.

In interlayers and protective layer, various kinds of reducing agents can be incorporated with the intentions of prevention of color mixing, improvement in color reproduction, and so on. Specifically, the reducing agents described in EP-A-0524649, EP-A-0357040, JP-A-4-249245, JP-A-2-46450 and JP-A-63-186240 can be used to advantage. In addition, the development inhibitor-releasing reducer compounds described in JP-B-3-63733, JP-A-1-150135, JP-A-2-46450, JP-A-2-64634, JP-A-3-43735 and EP-A-0451833 can be also employed.

In addition, the reducing agents as recited below may be incorporated in a photosensitive material.

Specifically, those which are usable in the present invention are the reducing agents and precursors thereof as described in U.S. Pat. No. 4,500,626 (columns 49–50), U.S. Pat. Nos. 4,839,272, 4,330,617, 4,590,152, 5,017,454 and 5,139,919, JP-A-60-140335 (pages 17-18), JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-244044, JP-A-62-131253, JP-A-62-131256, JP-A-64-13546 (pages 40–57), JP-A-1-120553, and EP-A2-0220746 (pages 78–96).

Also, the combinations of various reducing agents as disclosed in U.S. Pat. No. 3,039,869 can be used.

Developing agents or reducing agents as described above, though they may be incorporated in the processing material, are preferably incorporated in a photosensitive material.

In the present invention, the total amount of developing agents and reducing agents added is in the range of 0.01–20 moles, particularly preferably 0.1–10 moles, per mole of silver.

In the next place, imagewise release of diffusible dyes is illustrated below.

The present invention uses nondiffusible coloring materials capable of releasing diffusible dyes responding positively or negatively to silver development. These coloring materials can be represented by the following general formula (LI):

$$((\text{Dye})_m\text{—Y})_n\text{—Z} \qquad \text{(LI)}$$

wherein Dye represents a diffusible dye moiety, Y represents merely a linkage group, Z represents a group having the property of enabling the imagewise release of a diffusible moiety $(\text{Dye})_m$—Y in positive or negative response to a latent image formed in the light-sensitive silver salt and, at the same time, rendering the coloring material (LI) itself nondiffusible, m is an integer of from 1 to 5, and n is an integer of 1 or 2. When neither m nor n is 1, a plurality of Dye moieties may be the same or different.

Specific examples of a coloring material of the foregoing formula (LI) include the compounds classified into the following Groups (1) to (4). Additionally, the compounds classified as Groups (1) to (3) have the property of releasing a diffusible dye responding negatively to the development of silver halide, and the compounds classified as Group (4) have the property of releasing a diffusible dye responding positively to the development of silver halide.

The Group (1) includes the dye developers which each contain a hydroquinone developer attached to a dye moiety, as described, e.g., in U.S. Pat. Nos. 3,134,764, 3,362,819, 3,597,200, 3,544,545 and 3,482,972, and JP-B-3-68387. These dye developers are diffusible under an alkaline condition, but become nondiffusible by the reaction with silver halide.

The Group (2) includes, as described, e.g., in U.S. Pat. No. 4,503,137, nondiffusible compounds of the type which have a capability of releasing a diffusible dye under an alkaline condition but lose the capability by reacting with silver halide. As examples of such compounds, mention may be made of the compounds which release diffusible dyes by the intramolecular nucleophilic substitution reaction, as described, e.g., in U.S. Pat. No. 3,980,479; and the compounds which release diffusible dyes by the intramolecular rearrangement reaction of an isooxazolone ring, as described, e.g., in U.S. Pat. No. 4,199,354.

The Group (3) includes nondiffusible compounds of the type which release diffusible dyes by the reaction with a reducing agent remaining without undergoing oxidation upon development, as described, e.g., in U.S. Pat. No. 4,559,290, EP-A2-0220746, U.S. Pat. No. 4,783,396, Kokai Giho 87-6199 and JP-A-64-13546.

As examples of such compounds, mention may be made of the compounds which, after undergoing the reduction, release diffusible dyes by the intramolecular nucleophilic substitution reaction, as described, e.g., in U.S. Pat. Nos. 4,139,389 and 4,139,379, JP-A-59-185333 and JP-A-57-84453; the compounds which, after undergoing reduction, release diffusible dyes by the intramolecular electron transfer reaction, as described, e.g., in U.S. Pat. No. 4,232,107, JP-A-59-101649, JP-A-61-88257 and RD No. 24025 (1984); the compounds which, after undergoing reduction, release diffusible dyes by the single bond cleavage, as described, e.g., in West German Patent 3,008,588 A, JP-A-56-142530, and U.S. Pat. Nos. 4,343,893 and 4,619,884; the nitro compounds which release diffusible dyes after electron acceptance, as described, e.g., in U.S. Pat. No. 4,450,223; and the compounds which release diffusible dyes after electron acceptance, as described, e.g., in U.S. Pat. No. 4,609,610.

Further, examples of compounds more appropriate for Group (3) include the compounds described in EP-A2-0220746, Kokai Giho 87-6199, U.S. Pat. No. 4,783,396, JP-A-63-201653, JP-A-63-201654, JP-A-64-13546 and so on, which each have both N—X bond (wherein X represents an oxygen, sulfur or nitrogen atom) and electron-attracting group; the compounds described in JP-A-1-26842, which each have both $SO_2$—X bond (wherein X has the same meaning as the above) and electron-attracting group; the compounds described in JP-A-63-271344, which each have both PO—X bond (wherein X has the same meaning as the above) and electron attracting group; and the compounds described in JP-A-63-271341, which each have both C—X' bond (wherein X' has the same meaning as X, or represents —$SO_2$—) and electron-attracting group. In addition, the compounds described in JP-A-1-161237 and JP-A-1-161342, which each release a diffusible dye as a result of the cleavage of a single bond caused by the π-bond conjugated with an electron-accepting group after reduction, can also be employed.

Of those compounds, the compounds having both N—X bond (X=O, S or N) and electron-attracting group in each molecule are preferred over the others. Specific examples thereof include Compounds (1)–(3), (7)–(10), (12), (13), (15), (23)–(26), (31), (32), (35), (36), (40), (41), (44), (53)–(59), (64) and (70) described in EP-A2-0220746 or U.S. Pat. No. 4,783,396, Compounds (11)–(23) described in Kokai Giho 87-6199, and Compounds (1)–(84) described in JP-A-64-13546.

The Group (4) includes compounds of the type which can cause reduction in silver halide or an organosilver salt and release diffusible dyes when silver halide or an organosilver salt is reduced thereby (DRR compounds). These compounds have an advantage in that they can prevent images from being stained by oxidative decomposition products of a reducing agent since they don't require any other reducing agents. The representatives thereof are described, e.g., in U.S. Pat. Nos. 3,928,312, 4,053,312, 4,055,428 and 4,336,322, JP-A-59-65839, JP-A-59-69839, JP-A-53-3819, JP-A-51-104343, RD No. 17465, U.S. Pat. No. 3,725,062, 3,728,113 and 3,443,939, JP-A-58-116537, JP-A-57-179840, and U.S. Pat. No. 4,500,626. Specific examples of a DDR compound include the compounds described on columns 22 to 44 in the above-cited U.S. Pat. No. 4,500,626. Of these compounds, Compounds (1)–(3), (10)–(13), (16)–(19), (28)–(30), (33)–(35), (38)–(40) and (42)–(64) illustrated in the foregoing U.S. Patent are preferred over the others. In addition, the compounds illustrated on columns 37–39 in U.S. Pat. No. 4,639,408 are also useful.

In cases where diffusible dyes released imagewise are transferred to a processing material through their diffusion, it is desirable that a mordant be incorporated in the processing layer. Therein, mordants known in the photographic arts can be used, and specific examples thereof include the mordants described in U.S. Pat. No. 4,500,626 (columns 58–59), JP-A-61-88256 (pages 32–41), JP-A-62-244043 and JP-A-62-244036. Also, the dye-accepting high molecular compounds as described in U.S. Pat. No. 4,463,079 may be used as mordant.

Hydrophobic additives, such as coloring materials, couplers, color developing agents and nondiffusible reducing agents, can be introduced into constituent layers of a photosensitive material according to known methods, including the method described in U.S. Pat. No. 2,322,027. Therein, the high boiling organic solvents as described, e.g., in U.S. Pat. Nos. 4,555,470, 4,536,466, 4,536,467, 4,587,206, 4,555,476 and 4,599,296, and JP-B-3-62256 can be used, if necessary, together with a low boiling organic solvent having a boiling point of 50°–160° C. Additionally, each of these dye-providing compound, nondiffusible reducing agents and high boiling organic solvents can be employed as a mixture of two or more compounds.

The suitable amount of a high boiling organic solvent is not higher than 10 g, preferably not higher than 5 g, and more preferably from 1 g to 0.1 g, per gram of dye-providing compounds used. To 1 g of a binder, on the other hand, it is appropriate to use not more than 1 cc, preferably not more than 0.5 cc, particularly preferably not more than 0.3 cc, of a high boiling organic solvent.

Further, the polymer-utilized dispersion methods as described in JP-B-51-39853 and JP-A-51-59943, and the method of adding a hydrophobic additive in the form of fine-grain dispersion, as described in JP-A-62-30242, can be applied.

Furthermore, when the compounds to be introduced into a constituent layer are substantially insoluble in water, they can be first dispersed in the form of fine grains into a binder, and then introduced.

In dispersing a hydrophobic compound into a hydrophilic colloid, various types of surfactants can be used. Specifically, the surfactants described in JP-A-59-157636 (pages 37 and 38) and those described in RD, supra, can be employed. In addition, the surfactants of phosphate type described in JP-A-7-56267, JP-A-7-228589, and West German Patent Application (OLS) No. 1,932,299 can also be used.

In the present invention, compounds capable of activating the development and, at the same time, stabilizing images can be introduced into a photosensitive material. Suitable examples of such a compound are described in U.S. Pat. No. 4,500,626 (columns 51 and 52).

A photosensitive material for photographing use comprises at least three light-sensitive layers which differ from one another in spectral sensitivity and hue of a coloring material used therein. Each light-sensitive layer may be constituted of two or more silver halide emulsion layers which have substantially the same color sensitivity, but differ in photographic speed. Additionally, it is desirable that the aforesaid three light-sensitive layers be the layers sensitive to blue light, green light and red light, respectively. As for the arranging order of those layers, a red-sensitive layer, a green-sensitive layer and a blue sensitive layer are generally arranged in that order on the support side. However, other arranging orders may be adopted depending on intended purposes. For instance, the arrangement as described on column 162 in JP-A-7-152129 may be adopted.

In the present invention, silver halide and a coloring material may be incorporated in the same layer, but they can also be separately incorporated in different layers so far as they can react with each other. For example, the sensitivity can be prevented from lowering by arranging the layer containing a coloring material colored by nature underneath the layer containing silver halide.

The relationship between the spectral sensitivity and the hue of a coloring material in each layer can be arbitrarily chosen. However, when a cyan coupler is incorporated in a red-sensitive layer, a magenta coupler in a green-sensitive layer, and a yellow coupler in a blue-sensitive layer, it becomes possible to subject conventional color paper and the like to direct projection exposure.

In the photosensitive material, various layers insensitive to light, such as a protective layer, a subbing layer, an interlayer, a yellow filter layer and an antihalation layer, may be provided between silver halide emulsion layers described above, or as the topmost or lowest layer; while, on the back side of the support, various auxiliary layers, such as a backing layer, can be provided. Specific examples of light-insensitive layers which can be provided include the layer constitution as described in JP-A-7-152129, the subbing layer described in U.S. Pat. No. 5,051,335, the solid pigment-containing interlayers as described in JP-A-1-167838 and JP-A-61-20943, the interlayers containing a reducing agent and a DIR compound as described in JP-A-1-120553, JP-A-5-34884 and JP-A-2-64634, the electron transmitter-containing interlayers as described in U.S. Pat. No. 5,017,454, U.S. Pat. No. 5,139,919 and JP-A-2-235044, the reducer-containing protective layers as described in JP-A-4-249245, and the combination of two or more of the layers recited above.

To a photosensitive material, a thermal solvent may be added for the purpose of accelerating heat development. As examples of such a thermal solvent, mention may be made of the polar organic compounds as described in U.S. Pat. Nos. 3,347,675 and 3,667,959. More specifically, amide derivatives (such as benzamide), urea derivatives (such as methyl urea and ethylene urea), the sulfonamide derivatives (such as the compounds described in JP-B-1-40974 and JP-B-4-13701), polyol compounds (such as sorbitols) and polyethylene glycols can be used as thermal solvent.

When the thermal solvent used is insoluble in water, it is desirable for the solvent to be used in the form of solid dispersion. The layer to which a thermal solver is added may be chosen from light-sensitive layers or light-insensitive layers depending on the intended purpose.

The proportion of the thermal solvent added is from 10 to 500 weight %, preferably from 20 to 300 weight %, to the binder in the layer to which the thermal solvent is added.

For the photosensitive material and the processing material used in the present invention, it is desirable to be hardened with a hardener.

As examples of such a hardener, mention may be made of the hardeners described, e.g., in U.S. Pat. No. 4,678,739 (on column 41), U.S. Pat. No. 4,791,042, JP-A-59-116655, JP-A-62-245261, JP-A-61-18942, and JP-A-4-218044. More specifically, the hardener can be selected from among aldehyde hardeners (such as formaldehyde), aziridine hardeners, epoxy hardeners, vinylsulfone hardeners (e.g., N,N'-ethylenebis(vinylsulfonylacetamido)ethane), N-methylol hardeners (such as dimethylol urea), boric acid, metaboric acid and polymeric hardeners (such as the compounds described in JP-A-62-234157).

These hardeners can be used in a proportion of 0.001 to 1 g, preferably 0.005 to 0.5 g, to 1 g of a hydrophilic binder.

In the photosensitive material can be used various antifoggants, photographic stabilizer and precursors thereof. Specific examples of such agents include the compounds described, e.g., in RD, supra, U.S. Pat. Nos. 5,089,378, 4,500,627 and 4,614,702, JP-A-64-13564 (pages 7–9, 57–71 and 81–97), U.S. Pat. Nos. 4,775,610, 4,626,500 and 4,983,494, JP-A-62-174747, JP-A-62-239148, JP-A-1-150135, JP-A-2-110557, JP-A-2-178650, and RD No. 17643, pages 24–25 (1978).

Those compounds are used in an amount of $5\times10^{-6}$ to $1\times10^{-1}$ mole, preferably $1\times10^{-5}$ to $1\times10^{-2}$ mole, per mole of silver.

The photosensitive material and the processing material used in the present invention can contain various surfactants for a wide variety of purposes, for instance, as a coating aid, improvements in releasability and slippability, prevention of generation of static charges, acceleration of development, and so on. Specific examples of such surfactants are described, e.g., in *Kochi Gijutsu* No. 5, pp. 136–138 (published in Mar. 22, 1991, by Azutec Company Inc.), JP-A-62-173463 and JP-A-62-183457.

Also, organic fluorinated compounds may be added to the photosensitive material and the processing material with the intentions of making improvements in slippability and releasability, preventing static charges from generating, and so on. Typical examples of an organic fluorinated compound usable for such intentions include fluorine-containing surfactants as described in JP-B-57-9053 (columns 8–17), JP-A-6-20944 and JP-A-62-135826, and hydrophobic fluorine-containing compounds, such as oily fluorinated compounds, including fluorine-containing oils, and solid fluorinated compound resins such as a tetrafluoroethylene resin.

In the photosensitive material can be used a matting agent. Suitable examples of a matting agent include silicon dioxide, the compounds described in JP-A-61-88256 (page 29), such as polyolefin and polymethacrylate, and the compounds described in JP-A-63-274944 and JP-A-63-274952, such as benzoguanamine resin beads, polycarbonate resin beads and AS resin beads. In addition, the compounds described in RD, supra, can also be used.

As for the support of a photosensitive material used in the present invention, the support materials recited hereinbefore in the description of the processing material can be preferably used.

In particular, the supports described in JP-A-6-41281, JP-A-6-43581, JP-A-6-51426, JP-A-6-51437, JP-A-6-51442, JP-A-6-82961, JP-A-6-82960, JP-A-6-82959, JP-A-6-67346, JP-A-6-202277, JP-A-6-175282, JP-A-6-118561, JP-A-7-219129, JP-A-7-219144, U.S. Pat. No. 5,326,689 and Japanese Patent Application Nos. 4-253545 and 5-21625 can be appropriate for the photosensitive material because of their excellent anticurling properties.

Also, the support constituted mainly of a syndiotactic styrene polymer can be used to advantage.

Further, it is desirable to use the support provided with a magnetic layer as described in JP-A-4-124645, JP-A-5-40321, JP-A-6-35092, JP-A-6-317875, and Japanese Patent Application No. 5-58221, since photographic information can be recorded thereon.

The photograph-taking photosensitive material used in the present invention is processed similarly to usual color negatives, a camera is loaded therewith, and photographs can be taken directly using this camera. Also, it is favorable to apply this photosensitive material to the lens-attached film units described in JP-B-2-32615 and JP-B-U-3-39784 (The term "JP-B-U" as used herein means an "examined Japanese utility model publication").

The photosensitive material and/or the processing material may be provided with an electrically conductive heat-generating layer as a heating means for heat development. For the heat-generating element in this case, the material described in JP-A-61-145544 and so on can be utilized.

The heating temperature during the step of heat development ranges between about 50° C. to about 250° C., but the range of about 60° C. to about 180° C. is especially useful therefor. In the system of utilizing the release of diffusible dyes, the diffusion transfer of dyes may be performed simultaneously with heat development, or subsequently to the conclusion of heat development. In the latter case, the heating temperature during the transfer step can be chosen from the range of room temperature to the temperature adopted in the step of heat development. In particular, it is desirable to choose the heating temperature from the range of about 50° C. to the temperature lower than the heat development temperature by about 10° C.

Although the transfer of dyes can be caused by heating alone in the system of utilizing the release of diffusible dyes, it may be promoted by the use of a thermal solvent as recited above or other solvents.

In the present invention, it is useful to adopt a way to perform the development by the heating in the presence of a small amount of a fountain water. In this way, the heating temperature is desirably not lower than 50° C. and below the boiling point of water.

As examples of a fountain water used for acceleration of development and/or diffusion transfer of dyes, mention may be made of water, a basic water solution containing an inorganic alkali metal salt or an organic base (examples of these bases include those recited in the description of an image formation accelerator), low boiling solvents, and mixed solutions of low boiling solvents with water or the aforementioned basic water solutions. Further, therein may be present a surfactant, an antifoggant, a compound with which a sparingly soluble metal salt can be complexed, antimolds and antibacterial agents.

To the fountain water used during the heat development and/or diffusion transfer step, any types of water may be applicable. Specifically, distilled water, tap water, well water, mineral water and so on can be used. In an apparatus used for heat development of the photosensitive material of the type which is combined with an image-receiving element, water may be used only once and then discarded, or water may be circulated and used repeatedly. In the latter case, the water used comes to contain ingredients eluted from the material. Also, the apparatus and water as described, e.g., in JP-A-63-144354, JP-A-63-144355, JP-A-62-38460 or JP-A-3-210555 may be employed.

For the fountain water supplied to the photosensitive material, it is adequate to be used in an amount lower than the weight of water whose volume corresponds to the maximum swelling volume of the total coated layers present in the photosensitive material and the processing material.

As for the method of supplying water, the methods described, e.g., in JP-A-62-253159 (page 5) and JP-A-63-85544 are used to advantage. In addition, it is possible to adopt the method in which a solvent previously microencapsulated or made into the form of hydrate is incorporated into a photosensitive material, a dye-fixing element, or both of them.

The temperature of the supplied water is adequately from 30° C. to 60° C., as described in JP-A-63-85544 cited above.

As for the way of heating during the development and/or transfer step, the heating can be effected, e.g., by contact with a heated block or plate, with a heating means such, as a heating plate, a hot presser, a heating roller, a heating drum, a halogen lamp heater, an infrared lamp heater or a far infrared lamp heater, or by passage through a high temperature atmosphere.

In superposing the photosensitive material and the processing material upon each other, the methods described in JP-A-62-253159 and JP-A-61-147244 (page 27) can be applied.

For the heat-development processing in the present invention, any of conventional apparatuses for heat development can be used. For instance, the apparatuses described in JP-A-59-75247, JP-A-59-177547, JP-A-59-181353, JP-A-60-18951, JP-A-U-62-25944 and Japanese Patent Application Nos. 4-277517, 4-243072, 4-244693, 6-164421 and 6-164422 can be used to advantage. As for the commercial apparatuses on the market, the apparatuses made by Fuji Photo Film Co., Ltd., e.g., Pictrostat 100, Pictrostat 200, Pictrostat 300, Pictrography 3000 and Pictrography 2000, can be employed.

After the development-processing, no additional process for stopping the development is required in the present invention. By the incorporation of a development stopper in the processing material, however, the stopper may be made to work simultaneously with the development.

The term "development stopper" as used herein is intended to include compounds capable of stopping development by rapidly neutralizing or reacting with a base after the proper development to lower a base concentration in the coated layers, and compounds capable of inhibiting the development by interaction with silver and a silver salt. Specific examples of those compounds include acid precursors capable of releasing acids by heating, electrophilic compounds capable of causing the substitution reaction with a base contained in coated layers, nitrogen-containing heterocyclic compounds, mercapto compounds and precursors of those compounds. Further details of the development stopper are described in JP-A-62-253159, pages 31–32.

In addition, the combination of the photosensitive material in which a zinc mercaptocarboxylates is present, as described in JP-A-8-54705, with the processing material containing a complexing compound as recited above can be employed to advantage.

On the other hand, another form may be taken, in which an agent for inhibiting silver halide from being printed out (or a print-out inhibitor) is incorporated in advance in a processing sheet and made to perform its function upon development. Examples of a print-out inhibitor include the monohalogenated compounds described in JP-B-54-164, the trihalogenated compounds described in JP-A-53-46020, the compounds containing halogen-attached aliphatic carbon atoms described in JP-A-48-45228, and the polyhalogenated compounds, a representative of which is tetrabromoxylene, described in JP-A-57-8454. In addition, the development inhibitors described in British Patent 1,005,144, such as 1-phenyl-5-mercaptotetrazole, are also effective as print-out inhibitor.

Also, the viologen compounds described in Japanese Patent Application No. 6-337531 are used effectively.

It is preferable for such a print-out inhibitor to be used in an amount of from $10^{-4}$ to 1 mole per mole of Ag, particularly from $10^{-3}$ to $10^{-1}$ mole per mole of Ag.

The present invention will now be illustrated in greater detail by reference to the following examples. However, the invention should not be construed as being limited to these examples.

EXAMPLE 1

A color negative film (Photosensitive Material K01) was produced in the following manner:

(I) Preparation of Zinc Hydroxide Dispersion

Zinc hydroxide having an average grain size of 0.2 μm in an amount of 12.5 g and a dispersant constituted of 1 g of carboxymethyl cellulose and 0.1 g of sodium polyacrylate were added to 100 ml of a 4% aqueous solution of gelatin, and ground for 30 minutes using glass beads having an average size of 0.75 mm in a mill. Then, the glass beads were removed therefrom, and a dispersion of zinc hydroxide was obtained.

(II) Preparation of Electron Transmitter Dispersion

The electron transmitter illustrated below in an amount of 10 g and a dispersant constituted of 0.5 g of polyethylene glycol nonyl phenyl ether and 0.5 g of the following surfactant (1) were added to a 5% aqueous solution of gelatin, and ground for 60 minutes using glass beads having an average size of 0.75 mm in a mill. Then, the glass beads were removed therefrom, and an electron transmitter dispersion having an average particle size of 0.35 μm was obtained.

Electron Transmitter

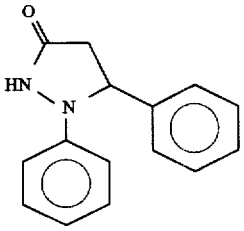

Surfactant (1)

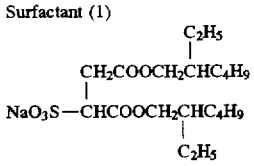

(III) Preparation of Gelatin Dispersions of Hydrophobic Additives

Gelatin dispersions of cyan dye-providing compound, magenta dye-providing compound, yellow dye-providing compound and electron donor were prepared according to their respective formulae shown in Table 1. More specifically, in preparing each dispersion, ingredients to constitute an oily phase were mixed and dissolved by heating to about 60° C. to make a homogeneous solution, and thereto a solution of ingredients to constitute an aqueous phase which was in advance heated to about 60° C. was added with stirring. The resultant mixture was dispersed at 12000 r.p.m. for 13 minutes by means of a homogenizer, and further a prescribed amount of water was added thereto with stirring. Thus, a homogeneous dispersion was obtained.

TABLE 1

| Ingredients | Cyan | Magenta | Yellow | Electron Donor |
|---|---|---|---|---|
| [Oily Phase] | | | | |
| Dye-providing Compound (1) | 9.05 g | — | — | — |
| Dye-providing Compound (2) | 6.19 g | — | — | — |
| Dye-providing Compound (3) | — | 15.5 g | — | — |
| Dye-providing Compound (4) | — | — | 9.77 g | — |
| Electron Donor (1) | 4.36 g | 5.73 g | 4.21 g | — |
| Electron Donor (2) | — | — | — | 13.9 g |
| Electron Donor (3) | — | 0.26 g | 0.54 g | — |
| Precursor of Electron Transmitter | 1.42 g | 1.42 g | 0.86 g | — |
| Compound (1) | 0.18 g | 0.22 g | 0.21 g | — |
| Compound (2) | 1.53 g | 1.94 g | — | — |
| Compound (3) | 1.52 g | 1.94 g | — | — |
| Precursor of Development Inhibitor | — | — | — | 2.63 g |
| High Boiling Solvent (1) | 1.91 g | 1.94 g | 3.67 g | — |
| High Boiling Solvent (2) | 7.60 g | 7.73 g | 3.67 g | 2.93 g |
| High Boiling Solvent (3) | — | — | — | 2.94 g |
| Surfactant (2) | 1.55 g | 0.52 g | 1.50 g | 0.45 g |
| Ethyl Acetate | 34.5 ml | 34.5 ml | 25.0 ml | 18.0 ml |
| Methyl Ethyl Ketone | 47.5 ml | 47.5 ml | — | — |
| [Aqueous Phase] | | | | |
| Lime-processed Gelatin | 10.0 g | 10.0 g | 10.0 g | 10.0 g |
| Citric Acid | — | — | — | 0.06 g |
| Sodium Hydrogen Sulfite | — | 0.04 g | — | 0.15 g |
| Water | 150 ml | 150 ml | 120 ml | 100 ml |
| Water added | 140 ml | 160 ml | 125 ml | 65 ml |

Dye-providing Compound (1)

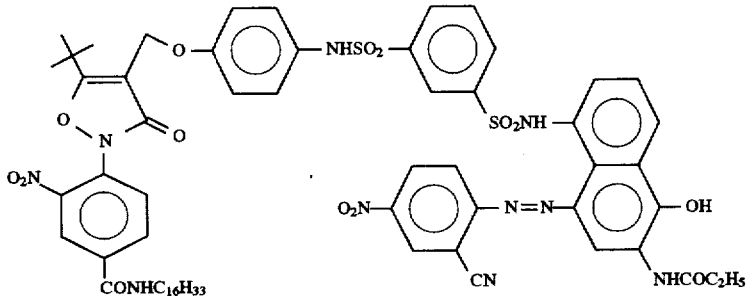

Dye-providing Compound (2)

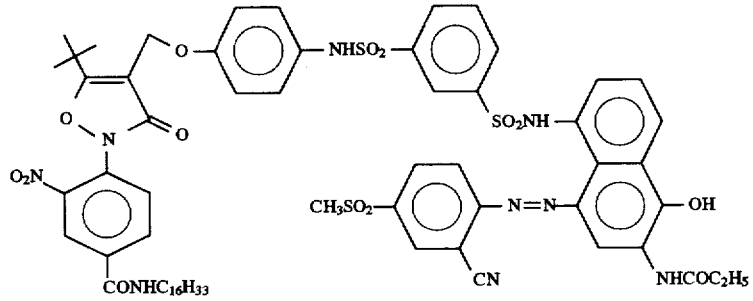

-continued
Dye-providing Compound (3)
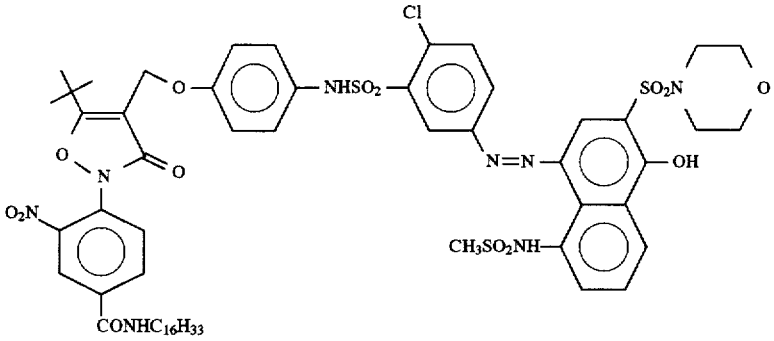
Dye-providing Compound (4)
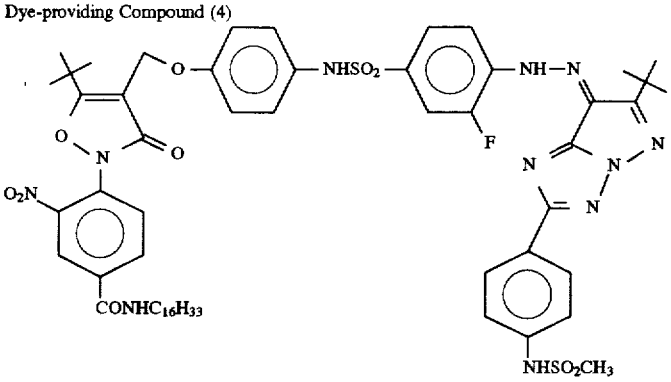
Electron Donor (1)
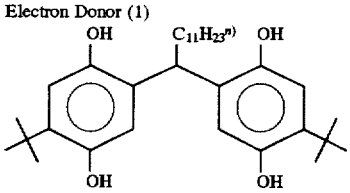
Electron Donor (2)
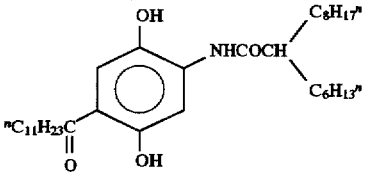
Electron Donor (3)
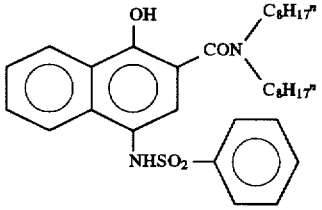
Precursor of Electron Transmitter
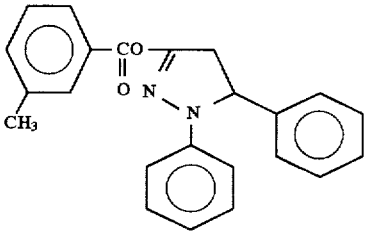

-continued
Compound (1)
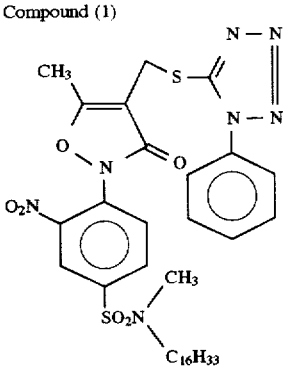
Compound (2)
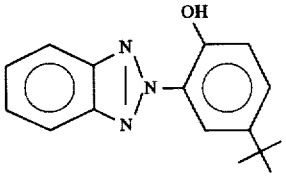
Compound (3)
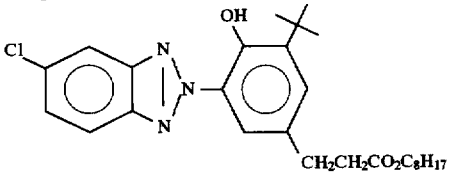
Precursor of Development Inhibitor
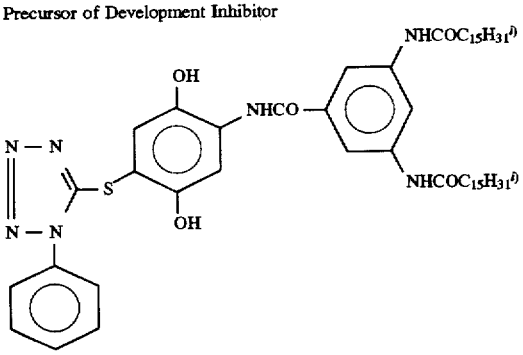
High Boiling Solvent (1)
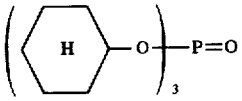
High Boiling Solvent (2)
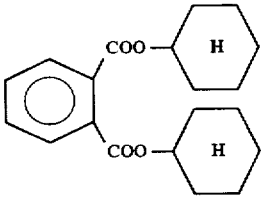
High Boiling Solvent (3)
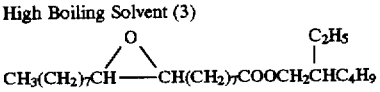

-continued

Surfactant (2)

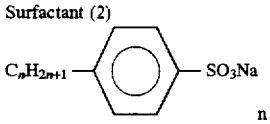

n = about 12.6

(IV) Preparation of Light-Sensitive Silver Halide Emulsions i) Light-Sensitive Silver Halide Emulsion (1) [for red-sensitive emulsion layer]

To a vigorously stirred aqueous gelatin solution (prepared by adding to 700 ml of water 20 g of gelatin, 0.5 g of potassium bromide, 2.5 g of sodium chloride and 15 mg of Chemical Agent (A) illustrated below, and keeping the resultant mixture at 42° C.), a silver nitrate solution (Soln. (I)) and a halide solution (Soln. (II)) set forth in Table 2 were added simultaneously over a 8-minute period at a constant flow rate. After an 8-minute lapse from the conclusion of the addition of Soln. (I) and Soln. (II), thereto was further added a dispersion of dyes in an aqueous gelatin solution (which contained in 160 ml of water 1.9 g of gelatin, 127 mg of Dye (a) illustrated below, 253 mg of Dye (b) illustrated below and 8 mg of Dye (c) illustrated below, and was kept at 35° C.). Two minutes later, the other silver nitrate solution (Soln. (III)) and the other halide solution (Soln. (IV)) set forth in Table 2 were added simultaneously thereto at a constant flow rate over a 32-minute period.

After performing washing and subsequent desalting steps in conventional manners, the emulsion obtained was admixed with 22 g of lime-processed ossein gelatin and 50 mg of the following Chemical Agent (B), adjusted to pH 6.2 and pAg 7.8, and then chemically sensitized at 68° C. to the optimum extent by adding thereto 4-hydroxy-6-methyl-1,3,3a,7-tetrazaindene first, and then sodium thiosulfate and chloroauric acid. Further, the thus sensitized emulsion was admixed with Antifoggant (1) illustrated hereinafter, 80 mg of Chemical Agent (C) and 3 g of Chemical Agent (D), and then cooled. Thus, 635 g of a monodisperse cubic silver chlorobromide emulsion having an average grain size of 0.21 μm was obtained.

TABLE 2

| Ingredient | Soln. (I) | Soln. (II) | Soln. (III) | Soln. (IV) |
|---|---|---|---|---|
| $AgNO_3$ | 20.0 g | — | 80.0 g | — |
| $NH_4NO_3$ | 0.19 g | — | 0.19 g | — |
| KBr | — | 9.9 g | — | 45.1 g |
| NaCl | — | 2.1 g | — | 5.4 g |
| Water to make | 110 ml | 110 ml | 250 ml | 250 ml |

Chemical Agent (A)

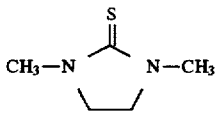

Chemical Agent (B)

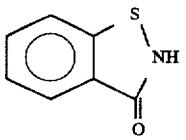

-continued

Chemical Agent (C)

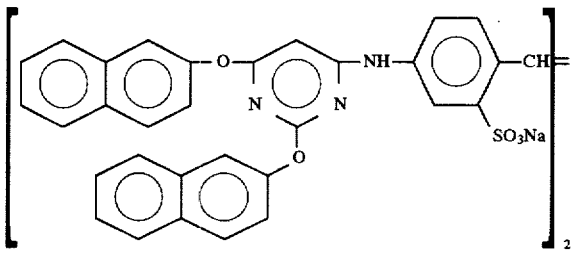

Chemical Agent (D)

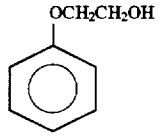

Dye (a)

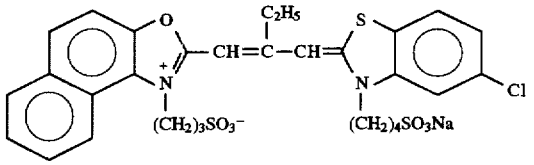

Dye (b)

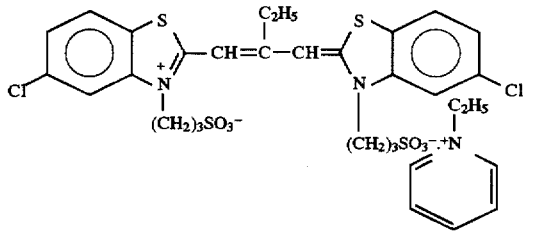

Dye (c)

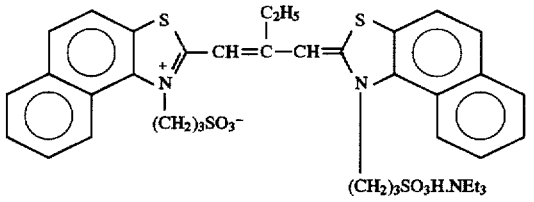

ii) Light-Sensitive Silver Halide Emulsion (2) [for red-sensitive emulsion layer]

To a vigorously stirred aqueous gelatin solution (prepared by adding to 700 ml of water 20 g of gelatin, 0.3 g of potassium bromide, 9 g of sodium chloride and 15 mg of Chemical Agent (A) illustrated above, and keeping the resultant mixture at 53° C.), a silver nitrate solution (Soln. (I)) and a halide solution (Soln. (II)) set forth in Table 3 were added simultaneously over a 10-minute period at a constant flow rate. After an 6-minute lapse from the conclusion of the addition of Soln. (I) and Soln. (II), thereto was further added a dispersion of dyes in an aqueous gelatin solution (which contained in 115 ml of water 1.2 g of gelatin, 77 mg of Dye (a) illustrated above, 153 mg of Dye (b) illustrated above and 5 mg of Dye (c) illustrated above, and was kept at 45° C.). Four minutes later, the other silver nitrate solution (Soln. (III)) and the other halide solution (Soln. (IV)) set forth in Table 3 were added simultaneously thereto at a constant flow rate over a 30-minute period.

After performing washing and subsequent desalting steps in conventional manners, the emulsion obtained was admixed with 33 g of lime-processed ossein gelatin and 50 mg of the foregoing Chemical Agent (B), adjusted to pH 6.2 and pAg 7.8, and then chemically sensitized at 68° C. to the optimum extent by adding thereto 4-hydroxy-6-methyl-1,3,3a,7-tetraazaindene first, and then sodium thiosulfate and chloroauric acid. Further, the thus sensitized emulsion was admixed with Antifoggant (1) illustrated hereinafter, 80 mg of the foregoing Chemical Agent (C) and 3 g of the foregoing Chemical Agent (D), and then cooled. Thus, 635 g of a monodisperse cubic silver chlorobromide emulsion having an average grain size of 0.45 μm was obtained.

TABLE 3

| Ingredient | Soln. (I) | Soln. (II) | Soln. (III) | Soln. (IV) |
|---|---|---|---|---|
| $AgNO_3$ | 20.0 g | — | 80.0 g | — |
| $NH_4NO_3$ | 0.19 g | — | 0.19 g | — |
| KBr | — | 12.2 g | — | 42.0 g |
| NaCl | — | 2.6 g | — | 5.2 g |
| Water to make | 120 ml | 120 ml | 225 ml | 225 ml |

After performing washing and subsequent desalting steps in conventional manners, the emulsion obtained was admixed with 22 g of lime-processed ossein gelatin, 50 mg of Chemical Agent (B) illustrated hereinbefore and 3 g of Chemical Agent (D) illustrated hereinbefore, adjusted to pH 6.0 and pAg 7.1, and then chemically sensitized at 60° C. to the optimum extent by adding thereto 4-hydroxy-6-methyl-1,3,3a,7-tetraazaindene first, and then sodium thiosulfate. Further, the thus sensitized emulsion was admixed with Antifoggant (1) illustrated hereinafter, and then cooled. Thus, 635 g of a monodisperse cubic silver chlorobromide emulsion having an average grain size of 0.23 μm was obtained.

TABLE 4

| Ingredient | Soln. (I) | Soln. (II) | Soln. (III) | Soln. (IV) |
|---|---|---|---|---|
| $AgNO_3$ | 20.0 g | — | 80.0 g | — |
| $NH_4NO_3$ | 0.06 g | — | 0.06 g | — |
| KBr | — | 4.9 g | — | 22.6 g |
| NaCl | — | 4.5 g | — | 16.6 g |
| $K_2IrCl_4$ | — | 0.008 mg | — | — |
| Water to make | 110 ml | 110 ml | 240 ml | 240 ml |

Dye (d)

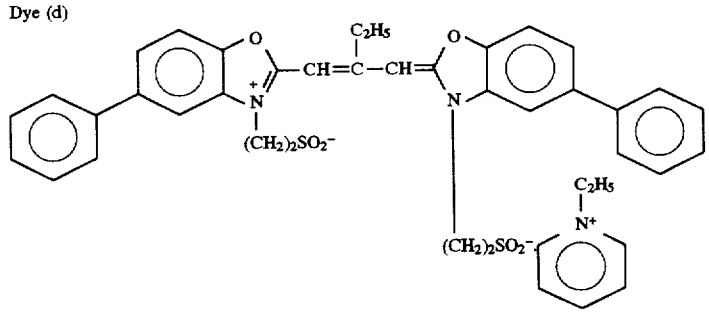

iii) Light-Sensitive Silver Halide Emulsion (3) [for green-sensitive emulsion layer]

To a vigorously stirred aqueous gelatin solution (prepared by adding to 690 ml of water 20 g of gelatin, 0.5 g of potassium bromide, 5 g of sodium chloride and 15 mg of Chemical Agent (A) illustrated above, and keeping the resultant mixture at 41° C.), a silver nitrate solution (Soln. (I)) and a halide solution (Soln. (II)) set forth in Table 4 were added simultaneously over a 8-minute period at a constant flow rate. Ten minutes later, the other silver nitrate solution (Soln. (III)) and the other halide solution (Soln. (IV)) set forth in Table 4 were added simultaneously thereto at a constant flow rate over a 32-minute period. After a 1-minute lapse from the conclusion of the addition of Soln. (III) and Soln. (IV), further thereinto was poured a methanol solution of dye (which contained 280 mg of Dye (d) illustrated below in 47 ml of methanol, and was kept at 30° C.).

iv) Light-Sensitive Silver Halide Emulsion (4) [for green-sensitive emulsion layer]

To a vigorously stirred aqueous gelatin solution (prepared by adding to 710 ml of water 20 g of gelatin, 0.3 g of potassium bromide, 9 g of sodium chloride and 7.5 mg of Chemical Agent (A) illustrated hereinbefore, and keeping the resultant mixture at 63° C.), a silver nitrate solution (Soln. (I)) and a halide solution (Soln. (II)) set forth in Table 5 were added simultaneously over a 10-minute period at a constant flow rate. Ten minutes later, the other silver nitrate solution (Soln. (III)) and the other halide solution (Soln. (IV)) set forth in Table 5 were added simultaneously thereto at a constant flow rate over a 20-minute period. After a 1-minute lapse from the conclusion of the addition of Soln. (III) and Soln. (IV), further thereinto was poured a methanol solution of dyes (which contained 210 mg of Dye (d-1) and 42.7 mg of Dye (d-2) illustrated below in 35 ml of methanol, and was kept at 46° C.).

After performing washing and subsequent desalting steps in conventional manners, the emulsion obtained was admixed with 33 g of lime-processed ossein gelatin, 50 mg of Chemical Agent (B) illustrated hereinbefore and 3 g of Chemical Agent (D) illustrated hereinbefore, adjusted to pH 6.0 and pAg 7.2, and then chemically sensitized at 60° C. to the optimum extent by adding thereto 4-hydroxy-6-methyl-1,3,3a,7-tetraazaindene first, and then sodium thiosulfate and chloroauric acid. Further, the thus sensitized emulsion was admixed with Antifoggant (1) illustrated hereinafter, and then cooled. Thus, 635 g of a monodisperse cubic silver chlorobromide emulsion having an average grain size of 0.45 μm was obtained.

TABLE 5

| Ingredient | Soln. (I) | Soln. (II) | Soln. (III) | Soln. (IV) |
|---|---|---|---|---|
| $AgNO_3$ | 25.0 g | — | 75.0 g | — |
| $NH_4NO_3$ | 0.06 g | — | 0.06 g | — |
| KBr | — | 6.2 g | — | 21.1 g |
| NaCl | — | 5.6 g | — | 15.5 g |
| $K_4[Fe(CN)_6]$ | — | — | — | 4 mg |
| Water to make | 120 ml | 120 ml | 225 ml | 225 ml |

Dye (d-1)

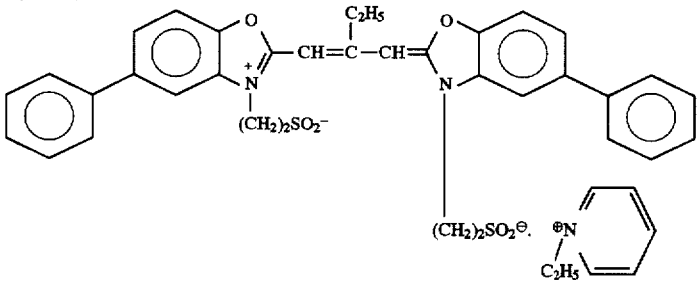

Dye (d-2)

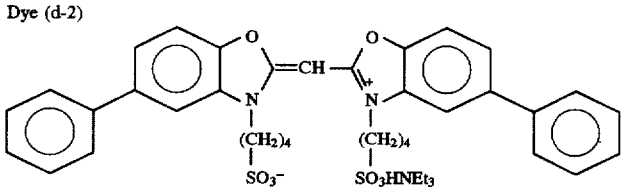

v) Light-Sensitive Silver Halide Emulsion (5) [for blue-sensitive emulsion layer]

To a vigorously stirred aqueous gelatin solution (prepared by adding to 690 ml of water 20 g of gelatin, 0.5 g of potassium bromide, 5 g of sodium chloride and 1.5 mg of Chemical Agent (A) illustrated hereinbefore, and keeping the resultant mixture at 46° C.), a silver nitrate solution (Soln. (I)) and a halide solution (Soln. (II)) set forth in Table 6 were added simultaneously over a 8-minute period at a constant flow rate. Ten minutes later, the other silver nitrate solution (Soln. (III)) and the other halide solution (Soln. (IV)) set forth in Table 6 were added simultaneously thereto at a constant flow rate over a 18-minute period. After a 1-minute lapse from the conclusion of the addition of Soln. (III) and Soln. (IV), further thereinto was poured an aqueous solution of dyes (which contained 225 mg of Dye (e) and 225 mg of Dye (f) illustrated below in the mixture of 95 ml of water with 5 ml of methanol, and was kept at 30° C.).

After performing washing and subsequent desalting steps in conventional manners, the emulsion obtained was admixed with 22 g of lime-processed ossein gelatin, 50 mg of Chemical Agent (B) illustrated hereinbefore and 3 g of Chemical Agent (D) illustrated hereinbefore, adjusted to pH 6.0 and pAg 7.7, and then chemically sensitized at 65° C. to the optimum extent by adding thereto 4-hydroxy-6-methyl-1,3,3a,7-tetraazaindene first, and then sodium thiosulfate. Further, the thus sensitized emulsion was admixed with Antifoggant (1) illustrated hereinafter, and then cooled. Thus, 635 g of a monodisperse cubic silver chlorobromide emulsion having an average grain size of 0.27 μm was obtained.

TABLE 6

| Ingredient | Soln. (I) | Soln. (II) | Soln. (III) | Soln. (IV) |
|---|---|---|---|---|
| $AgNO_3$ | 20.0 g | — | 80.0 g | — |
| $NH_4NO_3$ | 0.06 g | — | 0.06 g | — |
| KBr | — | 9.9 g | — | 45.0 g |
| NaCl | — | — | — | 7.6 g |
| $K_4[Fe(CN)_6]$ | — | — | — | 7 mg |
| Water to make | 110 ml | 110 ml | 240 ml | 240 ml |

Dye (e)

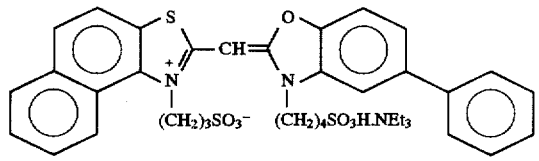

Dye (f)

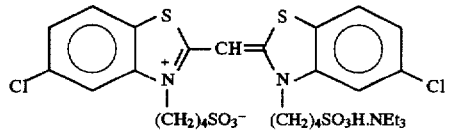

vi) Light-Sensitive Silver Halide Emulsion (6) [for blue-sensitive emulsion layer]

To a vigorously stirred aqueous gelatin solution (prepared by adding to 710 ml of water 20 g of gelatin, 0.3 g of potassium bromide, 9 g of sodium chloride and 15 mg of Chemical Agent (A) illustrated hereinbefore, and keeping the resultant mixture at 59° C.), a silver nitrate solution (Soln. (I)) and a halide solution (Soln. (II)) set forth in Table 7 were added simultaneously over a 8-minute period at a constant flow rate. Ten minutes later, the other silver nitrate solution (Soln. (III)) and the other halide solution (Soln. (IV)) set forth in Table 7 were added simultaneously thereto at a constant flow rate over a 18-minute period. After a 1-minute lapse from the conclusion of the addition of Soln. (III) and Soln. (IV), further thereinto was poured an aqueous solution of dyes (which contained 113 mg of Dye (e) and 113 mg of Dye (f) illustrated above in the mixture of 82 ml of water with 6 ml of methanol, and was kept at 40° C.).

After performing washing and subsequent desalting steps in conventional manners, the emulsion obtained was admixed with 33 g of lime-processed ossein gelatin, 50 mg of Chemical Agent (B) illustrated hereinbefore and 3 g of Chemical Agent (D) illustrated hereinbefore, adjusted to pH 6.0 and pAg 7.7, and then chemically sensitized at 65° C. to the optimum extent by adding thereto 4-hydroxy-6-methyl-1,3,3a,7-tetraazaindene first, and then sodium thiosulfate and chloroauric acid. Further, the thus sensitized emulsion was admixed with Antifoggant (1) illustrated hereinafter, and then cooled. Thus, 635 g of a monodisperse cubic silver chlorobromide emulsion having an average grain size of 0.47 μm was obtained.

TABLE 7

| Ingredient | Soln. (I) | Soln. (II) | Soln. (III) | Soln. (IV) |
|---|---|---|---|---|
| $AgNO_3$ | 20.0 g | — | 89.0 g | — |
| $NH_4NO_3$ | 0.06 g | — | 0.06 g | — |
| KBr | — | 10.0 g | — | 45.0 g |
| NaCl | — | 4.2 g | — | 5.5 g |
| Water to make | 100 ml | 100 ml | 260 ml | 260 ml |

A photosensitive material K01 having the constitution shown in Table 8 was produced using the aforementioned dispersions and silver halide emulsions.

TABLE 8

Constitution of Photosensitive Material K01

| Ordinal number of layer | Name of layer | Ingredients | Coverage rate (mg/m²) |
|---|---|---|---|
| 7th | Protective layer II | Acid-processed gelatin | 340 |
| | | PMMA latex (size: 3μ) | 15 |
| | | Colloidal silver | 0.8 |
| | | Surfactant (3) | 8 |
| | | Fluorine-containing Surfactant | 5 |
| | | Calcium nitrate | 6 |
| 6th | Protective layer I | Lime-processed gelatin | 640 |
| | | Zinc hydroxide | 420 |
| | | Electron Donor (2) | 87 |
| | | Precursor of Development Inhibitor | 16 |
| | | High Boiling Solvent (2) | 18 |
| | | High Boiling Solvent (3) | 18 |
| | | Dextran | 18 |
| | | Water-soluble Polymer (A) | 3 |
| | | Polymer Latex (1) | 36 |
| | | Surfactant (4) | 20 |
| | | Surfactant (2) | 3 |

TABLE 8-continued

Constitution of Photosensitive Material K01

| Ordinal number of layer | Name of layer | Ingredients | Coverage rate (mg/m²) |
|---|---|---|---|
| 5th | Blue-sensitive emulsion layer | Light-sensitive silver halide emulsion (5) | 440* |
| | | Light-sensitive silver halide emulsion (6) | 135* |
| | | Reducible Dye-providing Compound (4) | 300 |
| | | Gelatin | 615 |
| | | Electron Donor (1) | 127 |
| | | Electron Donor (3) | 16 |
| | | Precursor of Electron Transmitter | 26 |
| | | Compound (1) | 6 |
| | | High Boiling Solvent (1) | 110 |
| | | High Boiling Solvent (2) | 110 |
| | | Surfactant (2) | 45 |
| | | Antifoggant (1) | 1.2 |
| | | Water-soluble Polymer (A) | 23 |
| 4th | Interlayer | Lime-processed gelatin | 530 |
| | | Electron Donor (2) | 140 |
| | | Precursor of Development Inhibitor | 27 |
| | | High Boiling Solvent (2) | 30 |
| | | High Boiling Solvent (3) | 30 |
| | | Surfactant (2) | 4 |
| | | Polymer Latex (1) | 20 |
| | | Electron Transmitter | 67 |
| | | Dextran | 36 |
| | | Hardener (A) | 43 |
| | | Surfactant (4) | 10 |
| | | Water-soluble Polymer (A) | 20 |
| 3rd | Green-sensitive emulsion layer | Light-sensitive silver halide emulsion (3) | 280* |
| | | Light-sensitive silver halide emulsion (4) | 110* |
| | | Reducible Dye-providing Compound (3) | 366 |
| | | Lime-processed gelatin | 460 |
| | | Electron Donor (1) | 136 |
| | | Electron Donor (3) | 6 |
| | | Precursor of Electron Transmitter | 34 |
| | | Compound (1) | 6 |
| | | Compound (2) | 46 |
| | | Compound (3) | 46 |
| | | High Boiling Solvent (1) | 46 |
| | | High Boiling Solvent (2) | 183 |
| | | Antifoggant (1) | 1.0 |
| | | Water-soluble Polymer (A) | 16 |
| | | Surfactant (2) | 8 |
| 2nd | Interlayer | Lime-processed gelatin | 1060 |
| | | Zinc hydroxide | 700 |
| | | Electron Donor (2) | 140 |
| | | Precursor of Development Inhibitor | 27 |
| | | High Boiling Solvent (2) | 30 |
| | | High Boiling Solvent (3) | 30 |
| | | Surfactant (2) | 5 |
| | | Dextran | 31 |
| | | Water-soluble Polymer (A) | 5 |
| | | Polymer Latex (1) | 60 |
| | | Surfactant (4) | 33 |
| 1st | Red-sensitive emulsion layer | Light-sensitive silver halide emulsion (1) | 145* |
| | | Light-sensitive silver halide emulsion (2) | 80* |
| | | Reducible Dye-providing Compound (1) | 188 |
| | | Reducible Dye-providing Compound (2) | 128 |
| | | Lime-processed gelatin | 322 |
| | | Electron Donor (1) | 90 |
| | | Precursor of Electron Transmitter | 29 |

TABLE 8-continued

Constitution of Photosensitive Material K01

| Ordinal number of layer | Name of layer | Ingredients | Coverage rate (mg/m²) |
|---|---|---|---|
| | | Compound (1) | 4 |
| | | Compound (2) | 31 |
| | | Compound (3) | 31 |
| | | High Boiling Solvent (1) | 39 |
| | | High Boiling Solvent (2) | 158 |
| | | Antifoggant (1) | 0.7 |
| | | Water-soluble Polymer (A) | 12 |
| | | Surfactant (2) | 22 |

Support: Polyethylene naphthalate base (thickness: 100 μm)
*on a silver basis.

Surfactant (3)

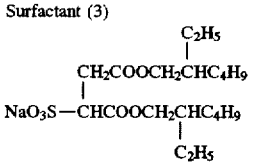

Surfactant (4)

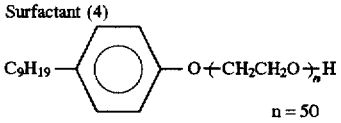

n = 50

Antifoggant (1)

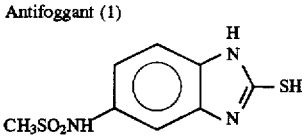

Fluorine-containing Surfactant $C_8F_{17}SO_2N(CH_2CH_2O)_nC_2H_8SO_3Na$
|
$C_3H_7$ n = 4.5

Water-soluble Polymer (A)

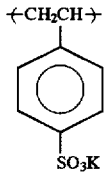

Hardener (A)

$CH_2=CHSO_2CH_2SO_2CH=CH_2$

Polymer Latex (1)

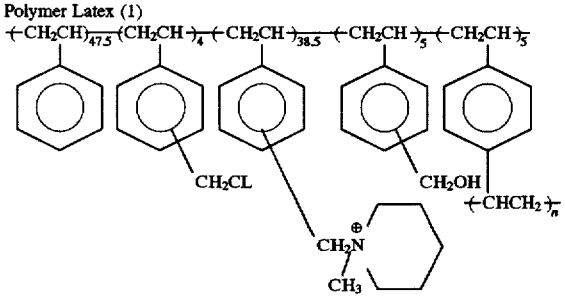

-continued

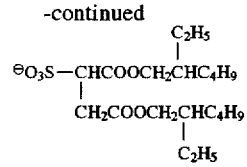

A processing material used in combination with the foregoing photosensitive material to form images on the photosensitive material was produced as follows:

Preparation of Dispersion of Additive (2)

In 100 g of High Boiling Solvent (1), 1 g of Additive (2) and 1.2 g of Anionic Surfactant (3) were dissolved under heating at 50° C. Separately, 60 g of lime-processed gelatin was swollen with 300 ml of water purified by ion exchangers, and then dissolved therein at 70° C., followed by addition of antiseptics thereto. These solutions were mixed at 40° C., and dispersed in the form of an emulsion by means of an ultrasonic dispersing apparatus. Thus, an emulsified dispersion of Additive (2) having an average particle size of 0.1–1μ was obtained.

Additive (2)

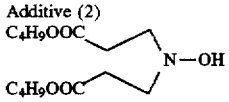

Anionic Surfactant (3)

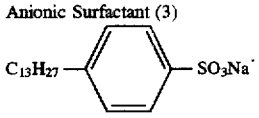

High Boiling Solvent (4)

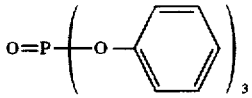

The thus prepared dispersion and ingredients set forth in Table 9 were coated so as to have the constitution shown in Table 9 on a support having the constitution shown in Table 10 wherein the polymer layer had a thickness of 6 μm, thereby producing Processing Material R101.

TABLE 9

Constitution of Processing Material R101

| Ordinal No. of Layer | Ingredients | Coverage Rate (mg/m²) |
|---|---|---|
| 4th | Acid-processed gelatin | 220 |
| | Water-soluble Polymer (1) | 60 |
| | Water-soluble Polymer (2) | 200 |
| | Additive (1) | 80 |
| | Colloidal silver | 5 |
| | Potassium nitrate | 12 |
| | Matting Agent (1) | 10 |
| | Anionic Surfactant (1) | 7 |
| | Anionic Surfactant (2) | 7 |
| | Amphoteric Surfactant (1) | 10 |
| 3rd | Lime-processed gelatin | 240 |
| | Water-soluble Polymer (2) | 24 |
| | Hardener (1) | 180 |
| | Anionic Surfactant (3) | 9 |
| 2nd | Lime-processed gelatin | 2400 |
| | Water-soluble Polymer (2) | 120 |
| | Water-soluble Polymer (3) | 2400 |
| | Water-soluble Polymer (4) | 700 |
| | Water-soluble Polymer (5) | 600 |
| | High Boiling Solvent (2) | 2000 |

TABLE 9-continued

Constitution of Processing Material R101

| Ordinal No. of Layer | Ingredients | Coverage Rate (mg/m²) |
|---|---|---|
| | Additive (2) | 20 |
| | Guanidine picolinate | 2910 |
| | Potassium quinolinate | 225 |
| | Sodium quinolinate | 180 |
| | Anionic Surfactant (3) | 24 |
| 1st | Gelatin | 280 |
| | Water-soluble Polymer (1) | 12 |
| | Anionic Surfactant (1) | 14 |
| | Sodium metaborate | 35 |
| | Hardener (1) | 185 |

Support: PET Support (constitution: A1)

TABLE 10

Support Constitution A1

| Name of Layer | Ingredient | Coverage Rate (mg/m²) |
|---|---|---|
| Front Subbing Layer | Gelatin | 100 |
| Polymer Layer | Polyethylene terephthalate | set forth in Table 11 |
| Back Subbing Layer | Styrene-acrylate copolymer<br>Colloidal silica<br>Sodium polystyrenesulfonate | 100 |

Additive (1)

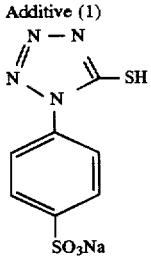

Hardener (1)

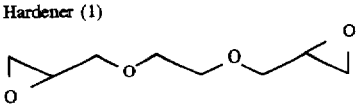

Anionic Surfactant (1)

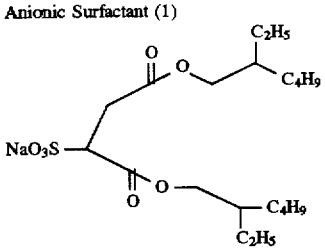

Anionic Surfactant (2)

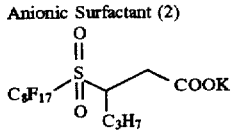

Water-soluble Polymer (1)
k-Carrageenan

-continued

Water-soluble Polymer (2)
Sumikagel L5H (trade name, produced by Sumitomo Chemical Co., Ltd.)

Water-soluble Polymer (3)

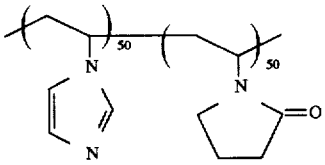

Water-soluble Polymer (4)
Dextran (molecular weight: $7 \times 10^4$)

Water-soluble Polymer (5)
MP Polymer MP102 (trade name, produced by Kuraray CO., Ltd.)

Amphoteric Surfactant (1)

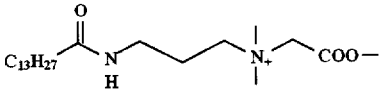

Matting Agent (1)
SYLOID 79 (trade mame, produced by Fuji Davison Chemical Co.)

In analogy with Processing Material R101, other Processing Materials R102 to R110 were produced. The support used in each processing material had a constitution set forth in Table 11, the details of which were shown in Tables 10, 12, 13 and 14, and the polymer or pulp layer present therein had the thickness set forth in Table 11.

TABLE 11

| Processing Material | Support Constitution | Thickness of Polymer Layer (μm) | Thickness of Pulp Layer (μm) | Total Thickness of Support (μm) |
|---|---|---|---|---|
| R101 | A1 | 6 | — | 7 |
| R102 | A1 | 25 | — | 26 |
| R103 | A1 | 38 | — | 39 |
| R104 | A1 | 63 | — | 64 |
| R105 | A1 | 102 | — | 103 |
| R106 | A2 | 25 | — | 26 |
| R107 | A3 | — | 40 | 72 |
| R108 | A3 | — | 70 | 102 |
| R109 | A4 | — | 40 | 92 |
| R110 | A4 | — | 80 | 132 |

TABLE 12

Support Constitution A2

| Name of Layer | Ingredient | Coverage Rate (mg/m²) |
|---|---|---|
| Front Subbing Layer | Gelatin | 100 |
| Polymer Layer | Polyethylene terephthalate | set forth in Table 11 |
| Back Subbing Layer | Methylmethacrylate-styrene-2-ethylhexylacrylate-methacrylic acid copolymer | 100 |
| | PMMA latex (ayerage particle size: 12 μm) | 120 |

TABLE 13

Support Constitution A3

| Name of Layer | Ingredient | Coverage Rate (mg/m²) |
|---|---|---|
| Front Subbing Layer | Gelatin | 0.1 |
| Front PE Layer (glossy) | Low density polyethylene (density: 0.923) 90.2 pts wt.<br>Surface-treated titanium oxide 9.8 pts wt.<br>Ultramarine 0.001 pt wt. | 36.0 |
| Pulp Layer | Wood free paper (LBKP/NBSP = 6/4; density: 1.053) | set forth in Table 11 |
| Back PE Layer (mat) | High density polyethylene (density: 0.955) | 31.0 |
| Back Subbing Layer | Styrene-acrylate copolymer<br>Colloidal silica<br>Sodium polystyrenesulfonate | 0.1 |

TABLE 14

Support Constitution A4

| Name of Layer | Ingredient | Coverage Rate (mg/m²) |
|---|---|---|
| Front Subbing Layer | Gelatin | 0.1 |
| Front PE Layer (glossy) | Low density polyethylene (density: 0.923) 90.2 pts wt.<br>Surface-treated titanium oxide 9.8 pts wt.<br>Ultramarine 0.001 pt wt. | 36.0 |
| Pulp Layer | Wood free paper (LBKP/NBSP = 6/4; density: 1.053) | set forth in Table 11 |
| Back PE Layer (mat) | High density polyethylene (density: 0.955) | 31.0 |
| Back Subbing Layer | Methylmethacrylate-styrene-2-ethylhexylacrylate-methacrylic acid copolymer | 1.0 |
| | PMMA latex (average particle size: 12 μm) | 0.1 |

The aforementioned photosensitive material K01 was cut into strips having the form of a 35 mm roll film with 36 exposures for general color negative, and subjected to a perforation operation. Then, a camera was loaded with one of those films, and close-up photographs of standard objects were taken therewith. Separately, a web having a length of 2 meters and a width of 40 mm was cut out from the foregoing Processing Material R101, and was wound onto a reel measuring 1 inch in diameter (the sending-out side) with its coating side turned outward. Thereafter, a head part of the web-form processing material was rolled in a separate reel (the winding side).

The resultant processing material was set so that its coating side was brought into contact with the outward face of a drum heater in a part between the sending-out reel and the winding reel. Then, a fountain water kept at 40° C. was spread at a coverage rate of 13 ml/m² over the photosensitive material exposed optically by shooting. The dampened face of the photosensitive material was laminated uniformly with the coating side of processing material at the position where the processing material came into contact with the drum heater, and the processing was performed under a condition that, while moving the processing material and the photosensitive material at the same speed as a rotating speed of the drum heater, the speed and the heater temperature were controlled so that the photosensitive material was heated for 20 seconds at 80° C. until it was peeled apart from the processing material. The peeling of the photosensitive material from the processing material was carried out at the position to separate the processing material from the drum heater. In this procedure, both laminating and peeling operations were performed without any trouble, and silver and dye images were formed in the photosensitive material. Moreover, the handling condition was satisfactory.

The superiority in handling characteristics during the image formation was remarkable when the processing material had its support thickness within the range of 4 μm to 40 μm (R101, R102, R103 and R106). However, not only the PET supports (R101 to R106) but also the double laminated paper supports (R107 to R110) were on a satisfactory level with respect to handling characteristics.

Further, the winding of the processing material with its coating side turned inward was favorable for handling because the processing material was hard to curl even when it was wound.

Also, satisfactory handling was effected in cases where a heater with a planar or curved shape, on which a carrying member was provided, was used as a heating means instead of the foregoing drum heater and the processing was performed by moving the foregoing photosensitive material and processing material on the carrying member.

EXAMPLE 2

A color positive Photosensitive Material (K02) was produced in the following manner:

Preparation of Gelatin Dispersion of Compound (d)

A homogeneous solution of Compound (d) was prepared by weighing out 0.4 g of Compound (d), 1.2 g of High Boiling Solvent (1), 0.12 g of Compound (f), 0.25 g of Compound (g), 0.05 g of Compound (h) and 0.2 g of Surfactant (1), adding thereto 9.5 ml of ethyl acetate, and heating them to about 60° C. This solution and 29.1 g of a 18% solution of lime-processed gelatin were mixed with stirring. The resultant mixture was dispersed at 10000 r.p.m. for 10 minutes by means of a homogenizer. The dispersion thus obtained was diluted with 18.5 ml of water. This dispersion was named Dispersion of Compound (d).

Compound (d)

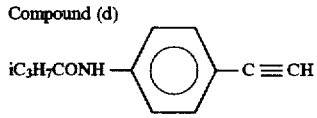

High Boiling Solvent (1)

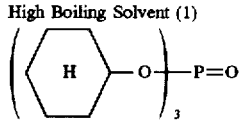

Compound (f)
$C_{26}H_{46.9}Cl_{7.1}$

-continued

Compound (g)

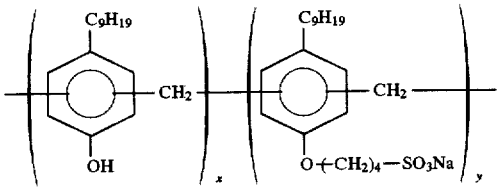

x/y = 58/42

Surfactant (1)

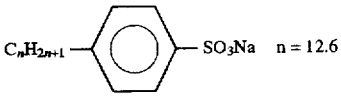

n = 12.6

Compound (h)

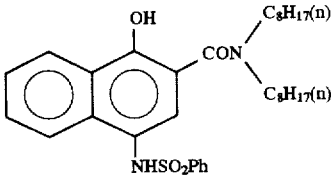

Preparation of Gelatin Dispersions of Dye-providing Compounds

A homogeneous solution of cyan dye-providing compounds was prepared by weighing out 7.3 g of Cyan Dye-providing Compound (A1), 11.0 g of Cyan Dye-providing Compound (A2), 0.8 g of Surfactant (1), 1 g of Compound (h), 2.2 g of Compound (i), 7 g of High Boiling Solvent (1) and 3 g of High Boiling Solvent (2), adding thereto 26 ml of ethyl acetate and 1.2 ml of water, and heating them to about 60° C. This solution, 65 g of a 16% solution of lime-processed gelatin and 87 ml of water were mixed with stirring. The resultant mixture was dispersed at 10000 r.p.m. for 10 minutes by means of a homogenizer. The dispersion thus obtained was diluted with 216 ml of water. This dispersion was named Dispersion of Cyan Dye-providing Compounds.

Cyan Dye-providing Compound (A1)

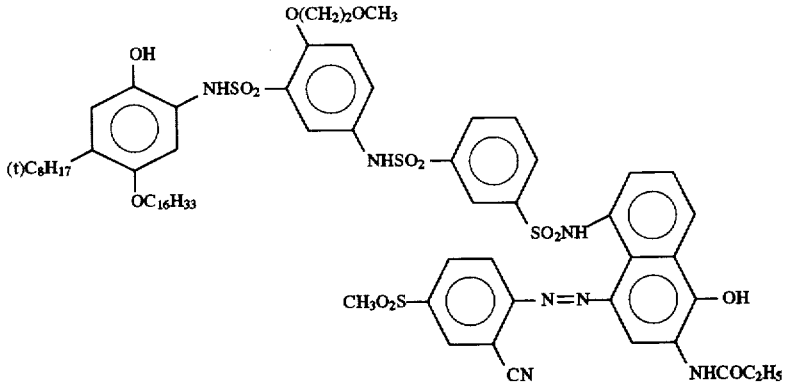

Cyan Dye-providing Compound (A2)

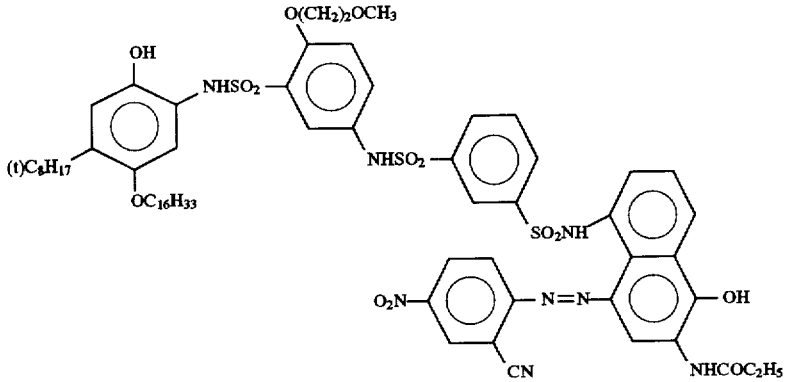

-continued

Compound (i)

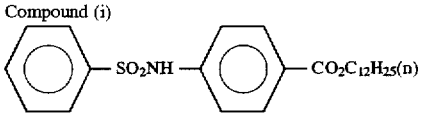

High Boiling Solvent (2)

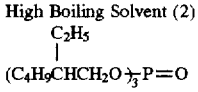

A homogeneous solution of magenta dye-providing compound was prepared by weighing out 4.50 g of Magenta Dye-providing Compound (B), 0.05 g of Compound (m), 0.05 g of Compound (h), 0.094 g of Surfactant (1) and 2.25 g of High Boiling Solvent (2), adding thereto 10 ml of ethyl acetate, and heating them to about 60° C. This solution, 15.2 g of a 16% solution of lime-processed gelatin and 23.5 ml of water were mixed with stirring. The resultant mixture was dispersed at 10000 r.p.m. for 10 minutes by means of a homogenizer. The dispersion thus obtained was diluted with 42 ml of water. This dispersion was named Dispersion of Magenta Dye-providing Compound.

A homogeneous solution of yellow dye-providing compound was prepared by weighing out 15 g of Yellow Dye-providing Compound (C), 2.3 g of Compound (d), 0.9 g of Compound (h), 0.88 g of Surfactant (1), 3.9 g of Compound (j), 1.9 g of Compound (k) and 16.9 g of High Boiling Solvent (1), adding thereto 49 ml of ethyl acetate, and heating them to about 60° C. This solution, 63.5 g of a 16% solution of lime-processed gelatin and 103 ml of water were mixed with stirring. The resultant mixture was dispersed at 10000 r.p.m. for 10 minutes by means of a homogenizer. The dispersion thus obtained was diluted with 94 ml of water. This dispersion was named Dispersion of Yellow Dye-providing Compound.

Magenta Dye-providing Compound (B)

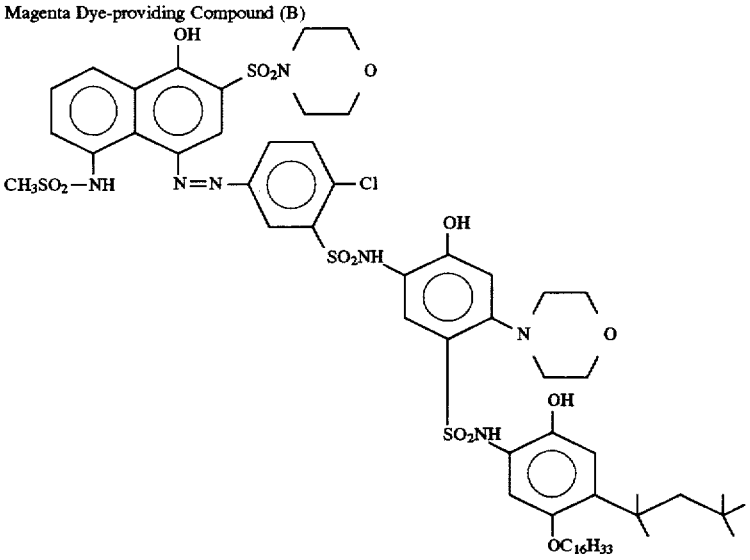

Compound (m)

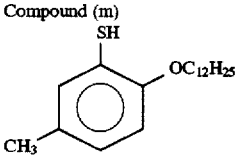

Yellow Dye-providing Compound (C)

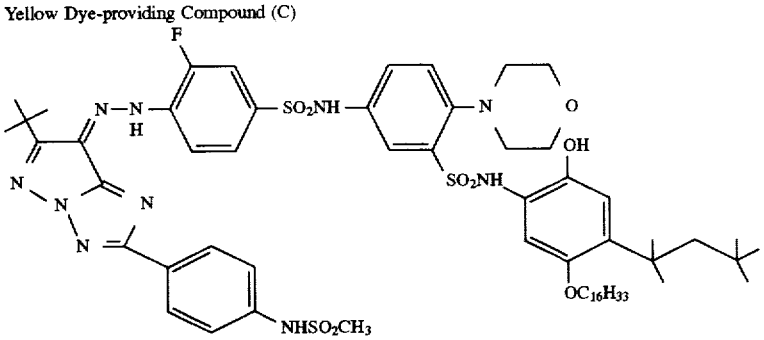

Compound (j)

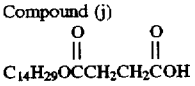

Compound (k)

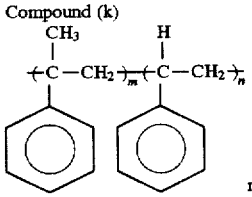

m/n = about 9/1

Using the above-described dispersions, a heat-developable Photosensitive Material K02 was produced so as to have the constitution shown in Table 15. As for the coverage rate set forth in Table 15, the figure corresponding to each silver halide emulsion represents the coverage rate based on silver.

TABLE 15

Constitution of Photosensitive Material K02

| Ordinal number of layer | Name of layer | Ingredients | Coverage rate (g/m$^2$) |
|---|---|---|---|
| 7th | Protective layer | Acid-processed gelatin | 0.387 |
| | | PMMA matting agent | 0.017 |
| | | Surfactant (2) | 0.006 |
| | | Surfactant (3) | 0.016 |
| 6th | Interlayer | Gelatin | 0.763 |
| | | Zinc hydroxide | 20.558 |
| | | Compound (d) | 0.036 |
| | | Compound (f) | 0.011 |
| | | Compound (g) | 0.022 |
| | | Compound (h) | 0.005 |
| | | High Boiling Solvent (1) | 0.107 |
| | | $Ca(NO_3)_2$ | 0.012 |
| | | Surfactant (3) | 0.022 |
| | | Water-soluble Polymer (1) | 0.003 |
| 5th | Blue-sensitive emulsion | Silver Halide Emulsion (6) | 0.200 |
| | | Silver Halide Emulsion (5) | 0.199 |
| | | Gelatin | 0.532 |
| | | Yellow Dye-providing Compound (C) | 0.348 |
| | | Compound (d) | 0.054 |
| | | Compound (h) | 0.021 |
| | | Compound (j) | 0.091 |
| | | Compound (k) | 0.045 |
| | | High Boiling Solvent (1) | 0.391 |
| | | Surfactant (1) | 0.021 |
| | | Water-soluble Polymer (1) | 0.006 |
| 4th | Interlayer | Gelatin | 0.467 |
| | | Zinc Hydroxide | 20.341 |
| | | Surfactant (3) | 0.001 |
| | | Compound (d) | 0.022 |

TABLE 15-continued

Constitution of Photosensitive Material K02

| Ordinal number of layer | Name of layer | Ingredients | Coverage rate (g/m$^2$) |
|---|---|---|---|
| | | Compound (f) | 0.007 |
| | | Compound (g) | 0.014 |
| | | Compound (h) | 0.003 |
| | | High Boiling Solvent (1) | 0.006 |
| | | $Ca(NO_3)_2$ | 0.008 |
| | | Surfactant (1) | 0.014 |
| | | Water-soluble Polymer (1) | 0.002 |
| 3rd | Green-sensitive emulsion layer | Silver Halide Emulsion (4) | 0.134 |
| | | Silver Halide Emulsion (3) | 0.100 |
| | | Gelatin | 0.311 |
| | | Magenta Dye-providing Compound (B) | 0.357 |
| | | Compound (m) | 0.004 |
| | | Compound (h) | 0.004 |
| | | High Boiling Solvent (4) | 0.178 |
| | | Surfactant (1) | 0.010 |
| | | Water-soluble Polymer (1) | 0.008 |
| 2nd | Interlayer | Gelatin | 0.513 |
| | | Surfactant (4) | 0.069 |
| | | Surfactant (3) | 0.007 |
| | | Compound (d) | 0.022 |
| | | Compound (f) | 0.007 |
| | | Compound (g) | 0.014 |
| | | Compound (h) | 0.003 |
| | | High Boiling Solvent (1) | 0.066 |
| | | $Ca(NO_3)_2$ | 0.004 |
| | | Water-soluble Polymer (1) | 0.020 |
| 1st | Red-sensitive emulsion layer | Silver halide emulsion (2) | 0.090 |
| | | Silver halide emulsion (1) | 0.070 |
| | | Gelatin | 0.294 |
| | | Cyan Dye-providing Compound (A1) | 0.141 |
| | | Cyan Dye-providing Compound (A2) | 0.211 |
| | | Compound (i) | 0.041 |
| | | Compound (h) | 0.020 |
| | | High Boiling Solvent (1) | 0.060 |
| | | High Boiling Solvent (4) | 0.138 |

TABLE 15-continued

Constitution of Photosensitive Material K02

| Ordinal number of layer | Name of layer | Ingredients | Coverage rate ($g/m^2$) |
|---|---|---|---|
| | | Surfactant (1) | 0.015 |
| | | Water-soluble Polymer (1) | 0.017 |
| | | Stabilizer | 0.005 |
| | | Hardener | 0.035 |

Support: Polyethylene terephthalate (thickness: 100 μm)

Stabilizer

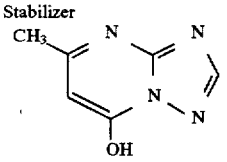

Hardener $CH_2=CHSO_2CH_2SO_2CH=CH_2$

The combination of the foregoing heat-developable Photosensitive Material K02 with each of the same processing materials as used in Example 1 (from R101 to R110) was prepared, processed and evaluated in the same manners as in Example 1. As the result thereof, every combination was found to be on a satisfactory level of handling characteristics during the processing operations and to form images in Photosensitive Material K02.

In performing the processing, the heating temperature and the heating time were changed to 83° C. and 35 seconds respectively from those employed in Example 1.

Further, a web, 2 meters long and 160 mm wide, was cut out from each processing material, and thereon 4 strips, 35 mm in width, of the Photosensitive Material K02 were disposed in a row, followed by subjecting all the strips to simultaneous processing. As the result thereof, it was found that images of almost the same qualities as in the aforesaid processing with respect to the photographic characteristics, such as Dmax, Dmin, gradation, and sensitivity, etc. were obtained whichever of the processing materials was used.

EXAMPLE 3

A photosensitive material (Photosensitive Material K03) was produced in the following manner:

1) Preparation of Emulsified Dispersion of Dye Composition

The combination of leuco dye(s) with the developer thereof and, if needed, a high boiling solvent were weighed out, and thereto ethyl acetate was added. The resulting mixture was heated at about 60° C. to converted into a homogeneous solution. A 100 ml portion of the solution was admixed with 1.0 g of Surfactant (1) and 190 ml of a 6.6% aqueous lime-processed gelatin solution heated at about 60° C., and dispersed thereinto at 10000 r.p.m. for 10 minutes by means of a homogenizer.

The dispersions of two types of dyes were prepared respectively in the above-described manner using the ingredients shown in Table 16.

TABLE 16

| Ingredient | Yellow Filter Dye | Antihalation Dye |
|---|---|---|
| Leuco Dye Y | 5.32 g | — |

TABLE 16-continued

| Ingredient | Yellow Filter Dye | Antihalation Dye |
|---|---|---|
| Leuco Dye B | — | 4.5 g |
| Leuco Dye M | — | 0.58 g |
| Developer | 30.2 g | 15 g |
| Oil (1) | — | 10 g |
| Ethyl Acetate | 60 ml | 75 ml |

Leuco Dye Y

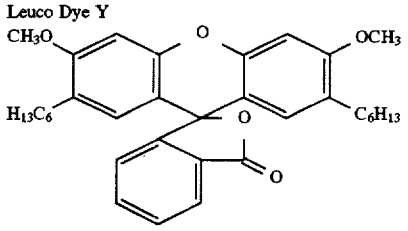

Developer

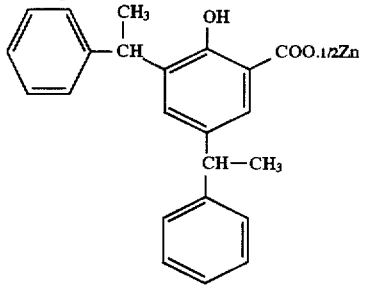

Leuco Dye B

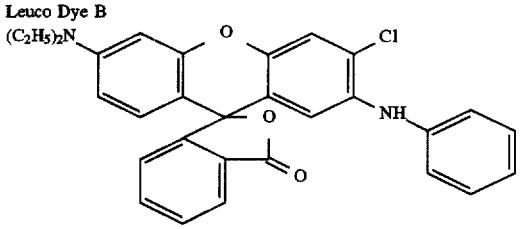

Surfactant (1)

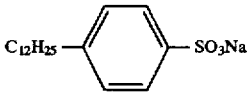

Leuco Dye M

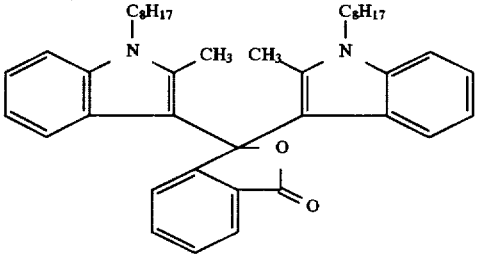

Oil (1)

$C_{26}H_{46.9}Cl_{7.1}$

2) Preparation of Light-sensitive Silver Halide Emulsions (i) Preparation of Light-Sensitive Emulsion (1) [for Red-Sensitive Emulsion Layer]

To a vigorously stirred aqueous gelatin solution (prepared by adding to 700 ml of water 20 g of gelatin, 0.5 g of potassium bromide, 2.5 g of sodium chloride and 15 mg of Chemical Agent (A) illustrated below, and keeping the resultant mixture at 42° C.), a silver nitrate solution (Soln. (I)) and a halide solution (Soln. (II)) set forth in Table 17 were added simultaneously over a 8-minute period at a constant flow rate. Further thereto, a dispersion of dyes in an aqueous gelatin solution (which contained in 160 ml of water 1.9 g of gelatin, 127 mg of Dye (a) illustrated below, 253 mg of Dye (b) illustrated below and 8 mg of Dye (c) illustrated below, and was kept at 35° C.) was added after an 8-minute lapse from the conclusion of the addition of Soln. (I) and Soln. (II). Two minutes later, the other silver nitrate solution (Soln. (III)) and the other halide solution (Soln. (IV)) set forth in Table 17 were added simultaneously thereto at a constant flow rate over a 32-minute period.

After performing washing and subsequent desalting steps in conventional manners, the emulsion obtained was admixed with 22 g of lime-processed ossein gelatin and 50 mg of Chemical Agent (B) illustrated below, adjusted to pH 6.2 and pAg 7.8, and then chemically sensitized at 68° C. to the optimum extent by adding thereto 4-hydroxy-6-methyl-1,3,3a,7-tetraazaindene first, and then sodium thiosulfate and chloroauric acid. Further, the thus sensitized emulsion was admixed with Antifoggant (1) illustrated below, 80 mg of Chemical Agent (C) and 3 g of Chemical Agent (D), and then cooled. Thus, 635 g of a monodisperse cubic silver chlorobromide emulsion having an average grain size of 0.21 μm was obtained.

TABLE 17

| Ingredient | Soln. (I) | Soln. (II) | Soln. (III) | Soln. (IV) |
|---|---|---|---|---|
| $AgNO_3$ | 20.0 g | — | 80.0 g | — |
| $NH_4NO_3$ | 0.19 g | — | 0.19 g | — |
| KBr | — | 9.9 g | — | 45.1 g |
| NaCl | — | 2.1 g | — | 5.4 g |
| Water to make | 110 ml | 110 ml | 250 ml | 250 ml |

Chemical Agent (A)

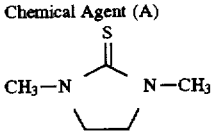

Chemical Agent (B)

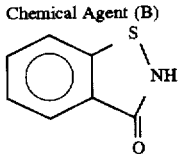

Chemical Agent (C)

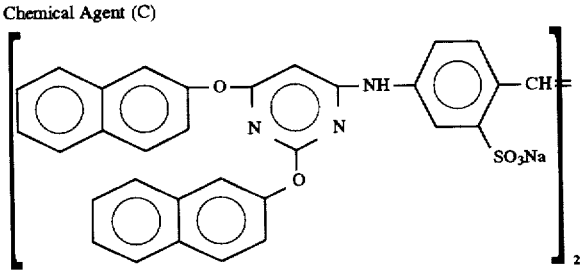

-continued

Chemical Agent (D)

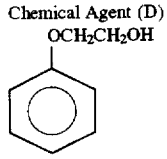

Dye (a)

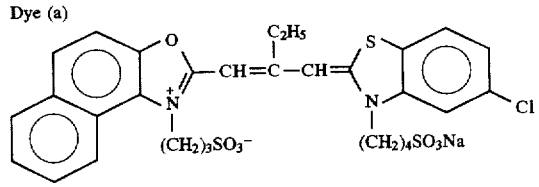

Dye (b)

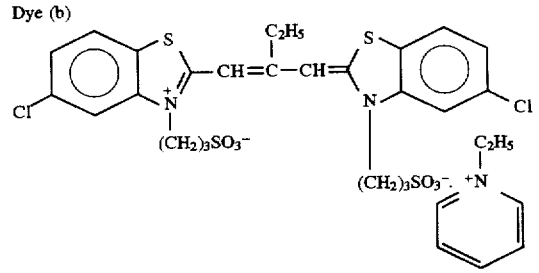

Dye (c)

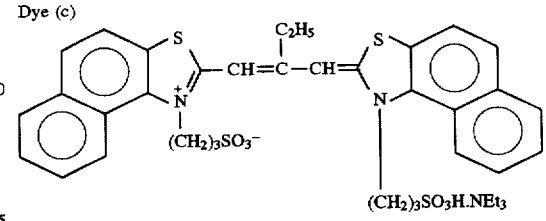

Antifoggant (1)

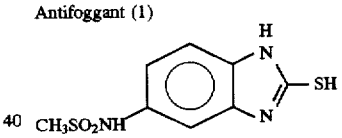

(ii) Preparation of Light-Sensitive Emulsion (2) [for Red-Sensitive Emulsion Layer]

To a vigorously stirred aqueous gelatin solution (prepared by adding to 700 ml of water 20 g of gelatin, 0.3 g of potassium bromide, 9 g of sodium chloride and 15 mg of Chemical Agent (A) illustrated above, and keeping the resultant mixture at 53° C.), a silver nitrate solution (Soln. (I)) and a halide solution (Soln. (II)) set forth in Table 18 were added simultaneously over a 10-minute period at a constant flow rate. Further thereto, a dispersion of dyes in an aqueous gelatin solution (which contained in 115 ml of water 1.2 g of gelatin, 77 mg of Dye (a) illustrated above, 153 mg of Dye (b) illustrated above and 5 mg of Dye (c) illustrated above, and was kept at 45° C.) was added after an 6-minute lapse from the conclusion of the addition of Soln. (I) and Soln. (II). Four minutes later, the other silver nitrate solution (Soln. (III)) and the other halide solution (Soln. (IV)) set forth in Table 18 were added simultaneously thereto at a constant flow rate over a 30-minute period.

After performing washing and subsequent desalting steps in conventional manners, the emulsion obtained was admixed with 33 g of lime-processed ossein gelatin and 50 mg of the foregoing Chemical Agent (B), adjusted to pH 6.2 and pAg 7.8, and then chemically sensitized at 68° C. to the optimum extent by adding thereto 4-hydroxy-6-methyl-1,3,3a,7-tetraazaindene first, and then sodium thiosulfate and chloroauric acid. Further, the thus sensitized emulsion was admixed with the foregoing Antifoggant (1), 80 mg of Chemical Agent (C) and 3 g of Chemical Agent (D), and then cooled. Thus, 635 g of a monodisperse cubic silver chlorobroinide emulsion having an average grain size of 0.45 μm was obtained.

TABLE 18

| Ingredient | Soln. (I) | Soln. (II) | Soln. (III) | Soln. (IV) |
|---|---|---|---|---|
| $AgNO_3$ | 20.0 g | — | 80.0 g | — |
| $NH_4NO_3$ | 0.19 g | — | 0.19 g | — |
| KBr | — | 12.2 g | — | 42.0 g |
| NaCl | — | 2.6 g | — | 5.2 g |
| Water to make | 120 ml | 120 ml | 225 ml | 225 ml |

(iii) Preparation of Light-Sensitive Emulsion (3) [for Green-Sensitive Emulsion Layer]

To a vigorously stirred aqueous gelatin solution (prepared by adding to 690 ml of water 20 g of gelatin, 0.5 g of potassium bromide, 5 g of sodium chloride and 15 mg of Chemical Agent (A) illustrated hereinabove, and keeping the resultant mixture at 41° C.), a silver nitrate solution (Soln. (I)) and a halide solution (Soln. (II)) set forth in Table 19 were added simultaneously over a 8-minute period at a constant flow rate. Ten minutes later, the other silver nitrate solution (Soln. (III)) and the other halide solution (Soln. (IV)) set forth in Table 19 were added simultaneously thereto at a constant flow rate over a 32-minute period. After a 1-minute lapse from the conclusion of the addition of Soln. (III) and Soln. (IV), further thereinto was poured a methanol solution of dye (which contained 2810 mg of Dye (d- 1) illustrated below and 57.3 mg of Dye (d-2) illustrated below in 47 ml of methanol, and was kept at 30° C.).

After performing washing and subsequent desalting steps in conventional manners, the emulsion obtained was admixed with lime-processed ossein gelatin, 50 mg of Chemical Agent (B) illustrated hereinabove and 3 g of Chemical Agent (D) illustrated hereinabove, adjusted to pH 6.2 and pAg 7.8, and then chemically sensitized at 60° C. to the optimum extent by adding thereto 4-hydroxy-6-methyl-1,3,3a,7-tetraazaindene first, and then sodium thiosulfate. Further, the thus sensitized emulsion was admixed with the foregoing Antifoggant (1), and then cooled. Thus, 635 g of a monodisperse cubic silver chlorobromide emulsion having an average grain size of 0.23 μm was obtained.

TABLE 19

| Ingredient | Soln. (I) | Soln. (II) | Soln. (III) | Soln. (IV) |
|---|---|---|---|---|
| $AgNO_3$ | 20.0 g | — | 80.0 g | — |
| $NH_4NO_3$ | 0.06 g | — | 0.06 g | — |
| KBr | — | 4.9 g | — | 22.6 g |
| NaCl | — | 4.5 g | — | 16.6 g |
| $K_2IrCl_4$ | — | 0.008 mg | — | — |
| Water to make | 110 ml | 110 ml | 240 ml | 240 ml |

Dye (d-1)

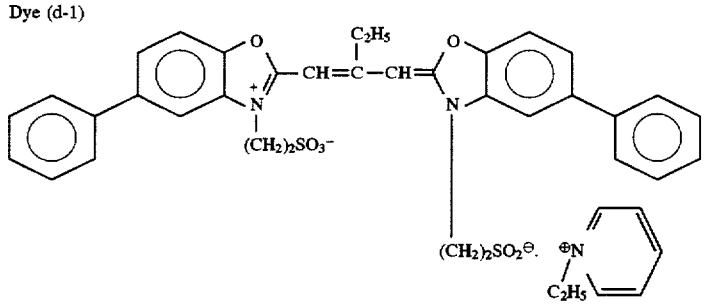

Dye (d-2)

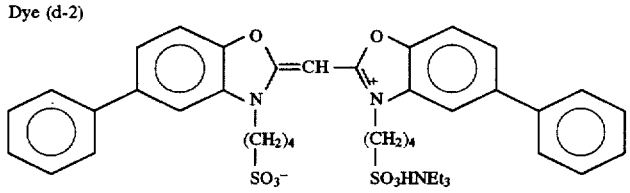

(iv) Preparation of Light-Sensitive Emulsion (4) [for Green-Sensitive Emulsion Layer]

To a vigorously stirred aqueous gelatin solution (prepared by adding to 710 ml of water 20 g of gelatin, 0.3 g of potassium bromide, 9 g of sodium chloride and 7.5 mg of Chemical Agent (A) illustrated hereinbefore, and keeping the resultant mixture at 63° C.), a silver nitrate solution (Soln. (I)) and a halide solution (Soln. (II)) set forth in Table 20 were added simultaneously over a 10-minute period at a constant flow rate. Ten minutes later, the other silver nitrate solution (Soln. (III)) and the other halide solution (Soln. (IV)) set forth in Table 20 were added simultaneously thereto at a constant flow rate over a 20-minute period. After a 1-minute lapse from the conclusion of the addition of Soln. (III) and Soln. (IV), further thereinto was poured a methanol solution of dyes (which contained 210 mg of Dye (d-1) and 42.7 mg of Dye (d-2) illustrated above in 35 ml of methanol, and was kept at 46° C.).

After performing washing and subsequent desalting steps in conventional manners, the emulsion obtained was admixed with 33 g of lime-processed ossein gelatin, 50 mg of Chemical Agent (B) illustrated hereinbefore and 3 g of Chemical Agent (D) illustrated hereinbefore, adjusted to pH 6.0 and pAg 7.2, and then chemically sensitized at 60° C. to the optimum extent by adding thereto 4-hydroxy-6-methyl- 1,3,3a,7-tetraazaindene first, and then sodium thiosulfate and chloroauric acid. Further, the thus sensitized emulsion was admixed with Antifoggant (1) illustrated hereinbefore, and then cooled. Thus, 635 g of a monodisperse cubic silver chlorobromide emulsion having an average grain size of 0.45 μm was obtained.

TABLE 20

| Ingredient | Soln. (I) | Soln. (II) | Soln. (III) | Soln. (IV) |
|---|---|---|---|---|
| $AgNO_3$ | 25.0 g | — | 75.0 g | — |
| $NH_4NO_3$ | 0.06 g | — | 0.06 g | — |
| KBr | — | 6.2 g | — | 21.1 g |
| NaCl | — | 5.6 g | — | 15.5 g |
| $K_4[Fe(CN)_6]$ | — | — | — | 4 mg |
| Water to make | 120 ml | 120 ml | 225 ml | 225 ml |

v) Light-Sensitive Silver Halide Emulsion (5) [for Blue-Sensitive Emulsion Layer]

To a vigorously stirred aqueous gelatin solution (prepared by adding to 690 ml of water 20 g of gelatin, 0.5 g of potassium bromide, 5 g of sodium chloride and 15 mg of Chemical Agent (A) illustrated hereinbefore, and keeping the resultant mixture at 46° C.), a silver nitrate solution (Soln. (I)) and a halide solution (Soln. (II)) set forth in Table 21 were added simultaneously over a 8-minute period at a constant flow rate. Ten minutes later, the other silver nitrate solution (Soln. (III)) and the other halide solution (Soln. (IV)) set forth in Table 21 were added simultaneously thereto at a constant flow rate over a 18-minute period. After a 1-minute lapse from the conclusion of the addition of Soln. (III) and Soln. (IV), further thereinto was poured an aqueous solution of dyes (which contained 225 mg of Dye (e) and 225 mg of Dye (f) illustrated below in the mixture of 95 ml of water with 5 ml of methanol, and was kept at 30° C.).

After performing washing and subsequent desalting steps in conventional manners, the emulsion obtained was admixed with 22 g of lime-processed ossein gelatin, 50 mg of Chemical Agent (B) illustrated hereinbefore and 3 g of Chemical Agent (D) illustrated hereinbefore, adjusted to pH 6.0 and pAg 7.7, and then chemically sensitized at 65° C. to the optimum extent by adding thereto 4-hydroxy-6-methyl-1,3,3a,7-tetraazaindene first, and then sodium thiosulfate. Further, the thus sensitized emulsion was admixed with Antifoggant (1) illustrated hereinbefore, and then cooled. Thus, 635 g of a monodisperse cubic silver chlorobromide emulsion having an average grain size of 0.27 μm was obtained.

TABLE 21

| Ingredient | Soln. (I) | Soln. (II) | Soln. (III) | Soln. (IV) |
|---|---|---|---|---|
| $AgNO_3$ | 20.0 g | — | 80.0 g | — |
| $NH_4NO_3$ | 0.06 g | — | 0.06 g | — |
| KBr | — | 9.9 g | — | 45.0 g |
| NaCl | — | — | — | 7.6 g |
| $K_4[Fe(CN)_6]$ | — | — | — | 7 mg |
| Water to make | 110 ml | 110 ml | 240 ml | 240 ml |

Dye (e)

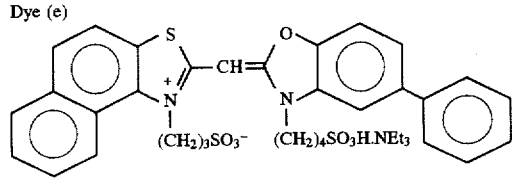

Dye (f)

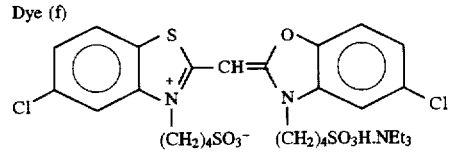

(vi) Preparation of Light-Sensitive Emulsion (6) [for Blue-Sensitive Emulsion Layer]

To a vigorously stirred aqueous gelatin solution (prepared by adding to 710 ml of water 20 g of gelatin, 0.3 g of potassium bromide, 9 g of sodium chloride and 1.5 mg of Chemical Agent (A) illustrated hereinbefore, and keeping the resultant mixture at 59° C.), a silver nitrate solution (Soln. (I)) and a halide solution (Soln. (II)) set forth in Table 22 were added simultaneously over a 8-minute period at a constant flow rate. Ten minutes later, the other silver nitrate solution (Soln. (III)) and the other halide solution (Soln. (IV)) set forth in Table 22 were added simultaneously thereto at a constant flow rate over a 18-minute period. After a 1-minute lapse from the conclusion of the addition of Soln. (III) and Soln. (IV), further thereinto was poured an aqueous solution of dyes (which contained 113 mg of Dye (e) and 113 mg of Dye (f) illustrated above in the mixture of 82 ml of water with 6 ml of methanol, and was kept at 40° C.).

After performing washing and subsequent desalting steps in conventional manners, the emulsion obtained was admixed with 33 g of lime-processed ossein gelatin, 50 mg of Chemical Agent (B) illustrated hereinbefore and 3 g of Chemical Agent (D) illustrated hereinbefore, adjusted to pH 6.0 and pAg 7.7, and then chemically sensitized at 65° C. to the optimum extent by adding thereto 4-hydroxy-6-methyl-1,3,3a,7-tetraazaindene first, and then sodium thiosulfate and chloroauric acid. Further, the thus sensitized emulsion was admixed with Antifoggant (1) illustrated hereinbefore, and then cooled. Thus, 635 g of a monodisperse cubic silver chlorobromide emulsion having an average grain size of 0.47 μm was obtained.

TABLE 22

| Ingredient | Soln. (I) | Soln. (II) | Soln. (III) | Soln. (IV) |
|---|---|---|---|---|
| $AgNO_3$ | 20.0 g | — | 80.0 g | — |
| $NH_4NO_3$ | 0.06 g | — | 0.06 g | — |
| KBr | — | 10.0 g | — | 45.0 g |
| NaCl | — | 4.2 g | — | 5.5 g |
| $K_4[Fe(CN)_6]$ | — | — | — | 7 mg |
| Water to make | 100 ml | 100 ml | 260 ml | 260 ml |

3) Preparation of Zinc Hydroxide Dispersion

A zinc hydroxide powder having a primary grain size of 0.2 μm in an amount of 31 g, a dispersant constituted of 1.6 g of carboxymethyl cellulose and 0.4 g of sodium polyacrylate, 8.5 g of lime-processed ossein gelatin and 158.5 ml of water were mixed together, and dispersed for 1 hour using glass beads in a mill. Then, the glass beads were removed therefrom, and 188 g of a dispersion of zinc hydroxide was obtained.

4) Preparation of Electron Transmitter Dispersion

The electron transmitter (a) illustrated below in an amount of 10 g and a dispersant constituted of 0.5 g of polyethylene glycol nonyl phenyl ether and 0.5 g of the following anionic surfactant (a) were added to a 5% water solution of gelatin, and ground for 60 minutes using glass beads having an average size of 0.75 mm in a mill. Then, the glass beads were removed therefrom, and an electron transmitter dispersion having an average particle size of 0.35 μm was obtained.

Surfactant (a)

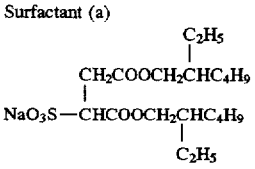

Electron Transmitter (a)

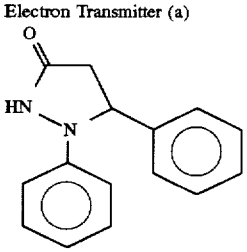

5) Preparation of Emulsified Dispersions of Couplers

Emulsified dispersions of cyan, magenta and yellow couplers were prepared according to their respective formulae shown in Table 23. More specifically, in preparing each emulsified dispersion, the ingredients to constitute an oily phase were mixed and dissolved by heating to about 60° C. to make a homogeneous solution, and separately the ingredients to constitute an aqueous phase were mixed and dissolved by heating to 60° C. to make a homogeneous solution. These homogeneous solutions were mixed in a 1 liter stainless vessel, and dispersed at 10000 r.p.m. for 20 minutes by means of a dissolver equipped with a disperser having a diameter of 5 cm. Further, warm water was added thereto in the amount shown in Table 23 and mixed for 10 minutes at 2000 r.p.m.

TABLE 23

Constitution of Coupler Emulsion

| Ingredients | Yellow | Magenta | Cyan |
|---|---|---|---|
| [Oily Phase] | | | |
| Yellow Coupler (Y1) | 5.82 g | — | — |
| Magenta Coupler (M1) | — | 5.15 g | — |
| Cyan Coupler (C1) | — | — | 4.95 g |
| Developing Agent (A) | 2.31 g | — | — |
| Developing Agent (B) | — | 1.88 g | — |
| Developing Agent (C) | | | 2.36 g |
| High Boiling Solvent (6) | 3.5 g | 3.5 g | 3.5 g |
| Antifoggant (5) | 0.005 g | 0.005 g | 0.005 g |
| Ethyl Acetate | 7 ml | 7 ml | 7 ml |
| Cyclohexanone | 2 ml | — | 2 ml |
| [Aqueous Phase] | | | |
| Surfactant (1) | 0.25 g | 0.25 g | 0.25 g |
| Gelatin | 3.26 g | 3.26 g | 3.26 g |
| Water | 37.5 ml | 37.5 ml | 37.5 ml |
| Water added after emulsification | 25 ml | 26 ml | 24 ml |

Antifoggant (5) was added in the form of a 1% ethanol solution, Surfactant (1) was added in the form of a 5% water solution, and the gelatin used was lime-processed gelatin and added in the form of a 14% water solution heated to 50° C.

Developing Agent (A)

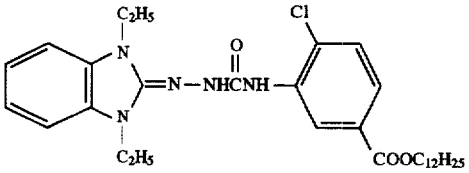

Developing Agent (B)

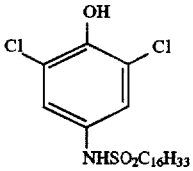

Yellow Coupler (Y1)

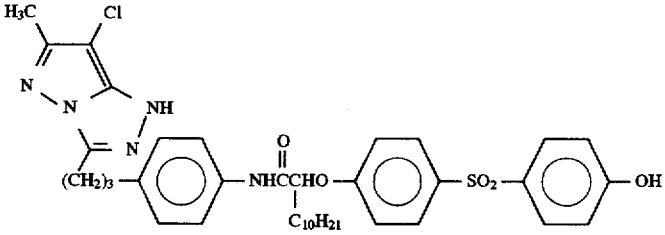

-continued

Magenta Coupler (M1)

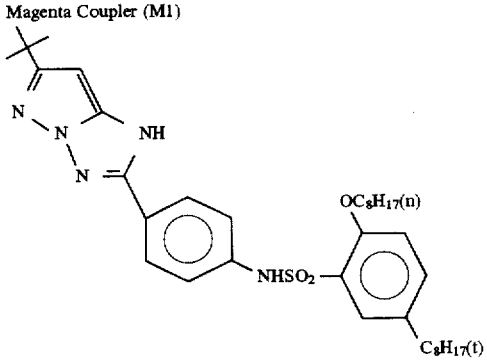

Cyan Coupler (Cl)

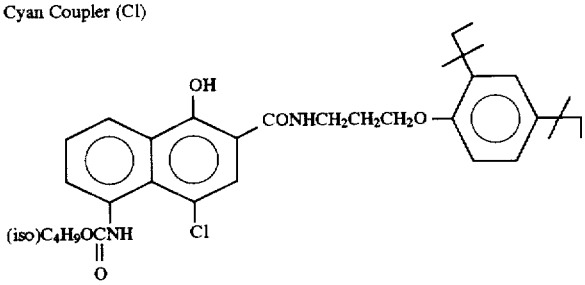

Developing Agent (C)

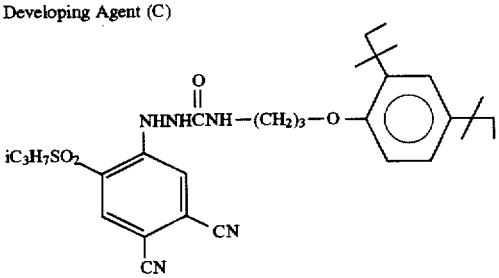

High Boiling Solvent (6)

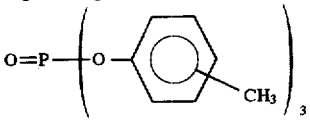

Antifoggant (5)

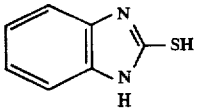

A heat developable color photosensitive material having a multilayer structure shown in Table 24 (Photosensitive Material K03) was produced using the aforementioned materials.

TABLE 24

Constitution of Photosensitive Material K03

| Layer Structure | | | Coverage |
|---|---|---|---|
| Ordinal number | Name of layer | Ingredients | rate (mg/m$^2$) |
| 8th | Protective layer (Pco) | lime-processed gelatin | 1000 |
| | | Matting agent (silica) | 200 |
| | | Surfactant (8) | 18 |

TABLE 24-continued

Constitution of Photosensitive Material K03

| Layer Structure | | | Coverage |
|---|---|---|---|
| Ordinal number | Name of layer | Ingredients | rate (mg/m$^2$) |
| | | Surfactant (9) | 5 |
| | | Hardener (2) | 210 |
| | | Water-soluble polymer (10) | 90 |
| 7th | Interlayer (Pcu) | Lime-processed gelatin | 1000 |
| | | Surfactant (8) | 10 |
| | | Surfactant (9) | 6 |
| | | Zinc hydroxide | 1300 |
| | | Water-soluble Polymer (10) | 6 |

TABLE 24-continued

Constitution of Photosensitive Material K03

| Layer Structure | | | Coverage |
|---|---|---|---|
| Ordinal number | Name of layer | Ingredients | rate (mg/m²) |
| 6th | Yellow color developing layer (BL) | Lime-processed gelatin | 2000 |
| | | Blue-sensitive silver halide emulsion (1) | 500* |
| | | Blue-sensitive silver halide emulsion (2) | 800* |
| | | Yellow coupler (Y1) | 1400 |
| | | Developing agent (A) | 570 |
| | | Antifoggant (5) | 1.5 |
| | | High Boiling Solvent (6) | 1000 |
| | | Surfactant (1) | 61 |
| | | Water-soluble Polymer (10) | 25 |
| 5th | Interlayer (YF) | Lime-processed gelatin | 970 |
| | | Surfactant (8) | 50 |
| | | Surfactant (9) | 300 |
| | | Zinc hydroxide | 400 |
| | | Leuco Dye Y | 250 |
| | | Developer | 1420 |
| | | Surfactant (1) | 45 |
| | | Water-soluble Polymer (10) | 60 |
| 4th | Magenta color developing layer (GL) | Lime-processed gelatin | 1560 |
| | | Green-sensitive silver halide emulsion (3) | 230* |
| | | Green-sensitive silver halide emulsion (4) | 461* |
| | | Magenta Coupler (M1) | 1140 |
| | | Developing agent (B) | 420 |
| | | Antifoggant (5) | 1.0 |
| | | High Boiling Solvent (6) | 880 |
| | | Surfactant (1) | 55 |
| | | Water-soluble Polymer (10) | 20 |
| 3rd | Interlayer (RMC) | Lime-processed gelatin | 970 |
| | | Surfactant (8) | 50 |
| | | Surfactant (9) | 300 |
| | | Zinc hydroxide | 400 |
| | | Water-soluble Polymer (10) | 60 |
| 2nd | Cyan color developing layer (RL) | Lime-processed gelatin | 2000 |
| | | Red-sensitive silver halide emulsion (5) | 400* |
| | | Red-sensitive silver halide emulsion (6) | 250* |
| | | Cyan coupler (C1) | 920 |
| | | Developing agent (C) | 440 |
| | | Antifoggant (5) | 1 |
| | | High boiling solvent (6) | 680 |
| | | Surfactant (1) | 46 |
| | | Water-soluble Polymer (10) | 15 |
| 1st | AH layer | Lime-processed gelatin | 1000 |
| | | Leuco dye B | 221 |
| | | Leuco dye M | 28 |
| | | Developer | 1480 |
| | | Oil (1) | 491 |
| | | Surfactant (1) | 46 |

Support: Transparent PET base (thickness: 102 μm)
*: silver basis

Surfactant (8)

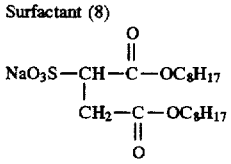

Surfactant (9)

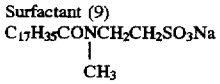

-continued

Water-soluble Polymer (10)

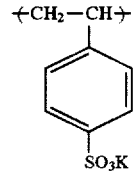

Hardener (2)
$CH_2=CHSO_2CH_2SO_2CH=CH_2$

Then, ten kinds of processing materials were produced as follows:

The ingredients set forth in Table 25 were coated so as to have the constitution shown in Table 25 on a support having the constitution shown in Table 10 (wherein the polymer layer had a thickness of 6 μm), thereby producing Processing Material R201.

TABLE 25

Constitution of Processing Material R201

| Ordinal No. of Layer | Ingredients | Coverage Rate (mg/m²) |
|---|---|---|
| 4th | Acid-processed gelatin | 220 |
| | Water-soluble Polymer (1) | 60 |
| | Water-soluble Polymer (2) | 200 |
| | Additive (1) | 80 |
| | Palladium sulfide | 3 |
| | Potassium nitrate | 12 |
| | Matting Agent (1) | 10 |
| | Anionic Surfactant (1) | 7 |
| | Anionic Surfactant (2) | 7 |
| | Amphoteric Surfactant (1) | 10 |
| 3rd | Lime-processed gelatin | 240 |
| | Water-soluble Polymer (2) | 24 |
| | Hardener (1) | 180 |
| | Anionic Surfactant (3) | 9 |
| 2nd | Lime-processed gelatin | 2400 |
| | Water-soluble Polymer (2) | 360 |
| | Water-soluble Polymer (4) | 700 |
| | Water-soluble Polymer (5) | 600 |
| | High Boiling Solvent (2) | 2000 |
| | Additive (2) | 20 |
| | Potassium hydantoin | 260 |
| | Guanidine picolinate | 2910 |
| | Potassium quinolinate | 225 |
| | Sodium quinolinate | 180 |
| | Anionic Surfactant (3) | 24 |
| 1st | Gelatin | 280 |
| | Water-soluble Polymer (1) | 12 |
| | Anionic Surfactant (1) | 14 |
| | Sodium metaborate | 35 |
| | Hardener (1) | 185 |

Support: PET Support (constitution: A1)

In analogy with Processing Material R201, other Processing Materials R202 to R210 were produced. The support used in each processing material had a constitution selected from those shown in Tables 10, 12, 13 and 14, and the polymer or pulp layer present therein had a thickness set forth in Table 11.

The combination of the foregoing Photosensitive Material K03 with each of the foregoing processing materials R201 to R210 was prepared, processed and evaluated in the same manners as in Example 1. As the result thereof, every combination was found to be on a satisfactory level of handling characteristics during the processing operations and to form images in Photosensitive Material K03.

In performing the processing, the heating temperature and the heating time were changed to 83° C. and 30 seconds respectively from those employed in Example 1.

Further, a web, 6 m long and 40 mm wide, was cut out from each processing material, and thereon 3 strips, 35 mm in width and 1.5 m in length, of Photosensitive Material K03, which were joined to one another in a series, were disposed in the longitudinal direction. Those strips was processed at a stretch by undergoing a continuous development. As the result thereof, it was confirmed that images were obtained similarly to the above and handling characteristics were satisfactory in these cases also.

EXAMPLE 4

A light-sensitive silver halide emulsion was prepared in the following manner: Solutions (I) and (II) shown in Table 27 were added simultaneously over a 10-minute period to a thoroughly stirred aqueous gelatin solution having the composition shown in Table 26. Two minutes later, Solutions (III) and (IV) shown Table 26 were added simultaneously thereto over a 18-minute period.

TABLE 26

| Composition of Aqueous Gelatin Solution | |
|---|---|
| $H_2O$ | 800 ml |
| Lime-processed gelatin | 20 g |
| NaCl | 4.2 g |
| Silver halide solvent (a) | 0.015 g |
| Antifoggant (a) | 0.011 g |
| Citric acid (10%) | 9 ml |

Temperature: 40° C.

TABLE 27

| Ingredients | Solution (I) | Solution (II) | Solution (III) | Solution (IV) |
|---|---|---|---|---|
| $AgNO_3$ | 75 g | | 125 g | |
| NaCl | | 27 g | | 45 g |
| KBr | | 1.5 g | | 2.5 g |
| $(NH_4)_3RhCl_6$ | | $1.8 \times 10^{-4}$ g | | |
| $K_3IrCl_6$ | | | | $7 \times 10^{-4}$ g |

TABLE 27-continued

| Ingredients | Solution (I) | Solution (II) | Solution (III) | Solution (IV) |
|---|---|---|---|---|
| Citric acid (10%) | | 0.1 ml | | 0.1 ml |
| Water to make | 240 ml | 240 ml | 400 ml | 400 ml |

Compound (a)

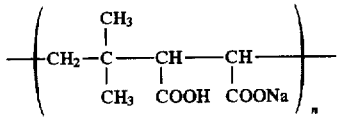

n = 400~500

Antiseptic (a)

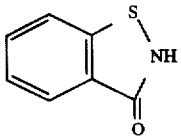

Stabilizer (a)

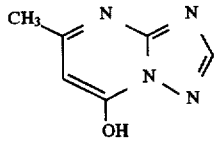

Silver Halide Solvent (a)

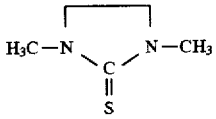

Antifoggant (a)

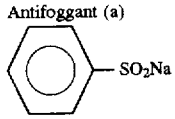

Therefrom, the salts produced was removed by sedimentation with a Compound (a) at pH 3.0 in a conventional manner. Then, the resulting emulsion was admixed with 50 g of delimed gelatin, adjusted to pH 5.7 and pAg 7.5, and further admixed with 0.1 g of an Antifoggant (a), followed by chemical sensitization at 60° C. The chemical sensitization was effected by using 0.003 g of hypo as sulfur sensitizer and 0.015 g of chloroauric acid as gold sensitizer and ripening for 60 minutes. Thereafter, 0.1 g of an Antiseptic (a) and 0.02 g of a Stabilizer (a) were further added. Thus, a silver chlorobromide emulsion having an average grain size of 0.20 μm was obtained.

A 100 g portion of this emulsion was admixed with 18.0 g of a Sensitizing Dye (a), 1.25 ml of a 1% methanol solution of Compound (b), 7.5 ml of a 0.8% methanol solution of Compound (c), 160 mg of a Surfactant (a) and 150 mg of a Water-soluble Polymer (a). Thus, the solution for an emulsion layer was obtained, and coated at a silver coverage of 1.4 g/m$^2$.

-continued

Sensitizing Dye (a)

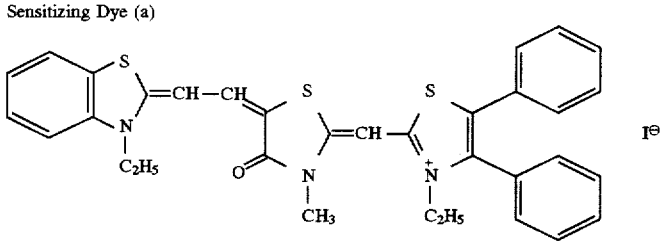

Compound (b)

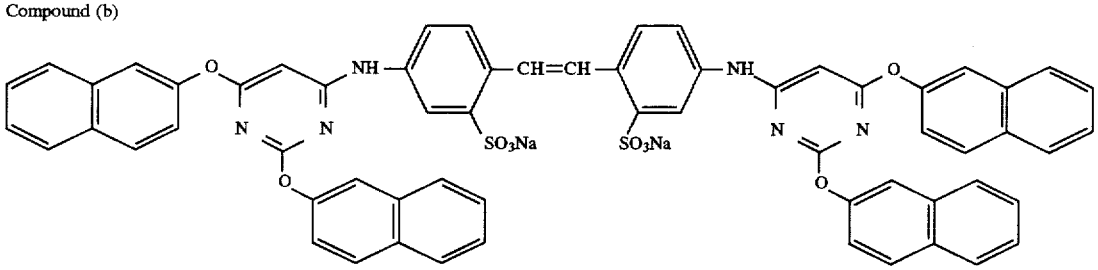

Compound (c)

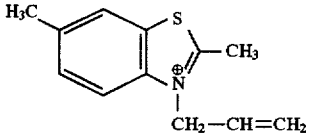

Surfactant (a)

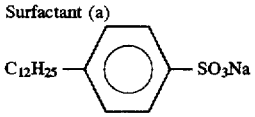

Water-Soluble Polymer (a)

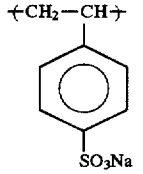

A dispersion of 1,5-diphenyl-3-pyrazolidone as a reducer was prepared as follows: Ten gram of 1,5-diphenyl-3-pyrazolidone and 0.2 g of Demol (a product of Kao Corporation) were added to 90 ml of a 5.7% solution of lime-processed gelatin, and dispersed for 30 minutes by means of a mill using glass beads having an average particle size of 0.75 mm. The glass beads were removed therefrom, and a dispersion of reducer in gelatin was obtained.

Further, a dispersion of Antihalation dye (a) as a solid in gelatin was prepared according to the above-described manner.

Antihalation dye (a)

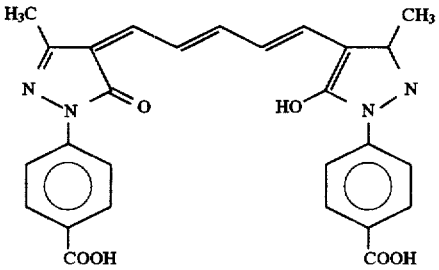

Furthermore, a dispersion of zinc hydroxide was prepared as follows: 12.5 g of zinc hydroxide having an average grain size of 0.2 μm and a dispersant constituted of 1 g of carboxymethyl cellulose and 0.1 g of sodium polyacrylate were added to 100 ml of a 4% aqueous gelatin solution, and dispersed for 30 minutes by means of a mill using glass beads having an average particle size of 0.75 mm. The glass beads were removed therefrom, and a dispersion of zinc hydroxide in gelatin was obtained.

A photosensitive material (Photosensitive Material K04) was produced so as to have the constitution shown in Table 28 using the foregoing dispersions and the ingredients shown in Table 28.

TABLE 28

Constitution of Photosensitive Material K04

| Name of Layer | Ingredients | Coverage Rate (mg/m²) |
|---|---|---|
| Fourth Layer (protective layer) | Acid-processed gelatin | 172 |
| | PMMA latex (2.5 μm) | 12 |
| | Sumikagel L5-H (produced by Sumitomo Chemical Co., Ltd.) | 64 |
| | Potassium nitrate | 3 |
| | Surfactant (b) | 1 |
| | Surfactant (c) | 5 |
| Third Layer (emulsion layer) | described hereinbefore | |
| Second Layer (interlayer) | Lime-processed gelatin | 725 |
| | Dextran | 62 |
| | Zinc hydroxide | 900 |
| | Hardener (a) | 35 |
| | Surfactant (c) | 7 |
| | Water-soluble polymer (a) | 10 |
| First Layer (antihalation layer) | Lime-processed gelatin | 640 |
| | Antihalation dye (1) | 150 |
| | 1,5-Diphenyl-3-pyrazolidone | 1650 |
| | Zinc thiosalicylate | 36 |
| | Surfactant (b) | 22 |
| | Water-soluble polymer (a) | 35 |
| Support: | 100 μm-thick polyethylene terephthalate (with a gelatin subbing layer) | |
| BC Second Layer (gelatin layer) | Lime-processed gelatin | 1900 |
| | Surfactant (d) | 5 |
| | PMMA latex (average particle size: 5.0μ) | 40 |
| | Hardener (a) | 30 |
| BC Third Layer (polymer layer) | Polymer*1) | 1000 |

*1)Copolymer of methyl methacrylate, styrene, 2-ethylhexyl acrylate and methacrylic acid Surfactant (b)

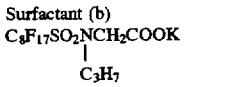

$C_8F_{17}SO_2N(C_3H_7)CH_2COOK$

Surfactant (c)

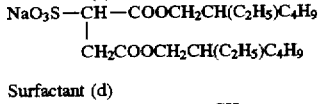

$NaO_3S-CH(CH_2COOCH_2CH(C_2H_5)C_4H_9)-COOCH_2CH(C_2H_5)C_4H_9$

Surfactant (d)

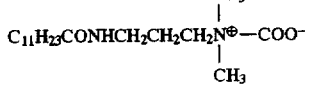

$C_{11}H_{23}CONHCH_2CH_2CH_2N^{\oplus}(CH_3)_2-COO^-$

-continued

Hardener (a)

$CH_2=CHSO_2CH_2SO_2CH=CH_2$

The foregoing Photosensitive Material K04 was cut into strips measuring 550 mm in width and 760 mm in length. A strip of Photosensitive Material K04 was exposed using a semiconductor laser device having its output peak wavelength at 670 nm at a scanning speed of 1/10000000 second per picture element (1100 μm²) as the exposure amount was changed. Separately, a web having a length of 21 meters and a width of 580 mm was cut out from the aforementioned Processing Material R101, and was wound onto a reel measuring 2 inch in diameter (the sending-out side) with its coating side turned inward. Thereafter, a head part of the web-form processing material was rolled in a separate reel (the winding side).

The resultant processing material was set so that its coating side faced the outward surface of a drum heater in a part between the sending-out reel and the winding reel. Then, the optically exposed photosensitive material was dipped for 2.5 seconds in water kept at 40° C., and squeezed with a roller so that the amount of water on the photosensitive material was 12 ml/m². The thus dampened face of the photosensitive material was laminated uniformly with the coating side of processing material, and the processing was performed under a condition that, while moving the processing material and the photosensitive material at the same speed as a rotating speed of the drum heater, the speed and the heater temperature were controlled so that the photosensitive material was heated for 18 seconds at 80° C. until it was peeled apart from the processing material. The processing material, was peeled apart from the photosensitive material at the position where the processing material left the heater drum, and subsequently the photosensitive material was separated from the drum. In this procedure, both laminating and peeling operations were performed without any trouble, and silver image was formed in the photosensitive material. Moreover, the handling condition was satisfactory.

While the invention has been described in detail and with reference to specific embodiments thereof, it will be apparent to one skilled in the art that various changes and modifications can be made therein without departing from the spirit and scope thereof.

What is claimed is:

1. A method of forming images by heat development, comprising the steps of:

providing a fountain water for a heat-developable photosensitive material comprising silver halide and a developing agent; and heating the photosensitive material in a condition that it is brought into face-to-face contact with a processing material comprising a long web support, wherein the support has a thickness of from 4 μm to 40 μm and has provided thereon a processing layer comprising a base or a precursor of bases, to form images on the photosensitive material.

2. The method of claim 1, wherein the content of the base or the precursor of bases in the processing layer is from 0.1 to 20 g/m².

3. The method of claim 1, wherein the content of the base or the precursor of bases in the processing layer is from 1 to 10 g/m².

* * * * *